US009767767B2

(12) United States Patent
Kong et al.

(10) Patent No.: US 9,767,767 B2
(45) Date of Patent: Sep. 19, 2017

(54) PIXEL, DISPLAY DEVICE INCLUDING THE PIXEL, AND METHOD OF DRIVING THE DISPLAY DEVICE

(71) Applicant: Samsung Display Co., Ltd., Yongin, Gyeonggi-Do (KR)

(72) Inventors: Ji-Hye Kong, Yongin (KR); Chul-Kyu Kang, Yongin (KR); Yong-Jae Kim, Yongin (KR); Young-In Hwang, Yongin (KR); So-Young Kang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 137 days.

(21) Appl. No.: 14/608,135

(22) Filed: Jan. 28, 2015

(65) Prior Publication Data

US 2015/0364116 A1 Dec. 17, 2015

(30) Foreign Application Priority Data

Jun. 11, 2014 (KR) ..... 10-2014-0071070

(51) Int. Cl.
*G09G 5/00* (2006.01)
*G09G 5/18* (2006.01)
(Continued)

(52) U.S. Cl.
CPC ..... *G09G 5/18* (2013.01); *G09G 3/3233* (2013.01); *G09G 3/3291* (2013.01);
(Continued)

(58) Field of Classification Search
CPC .. G09G 3/32; G09G 3/00; G09G 3/20; G09G 5/00; G09G 3/30; G09G 3/36; G06F 3/038
See application file for complete search history.

(56) References Cited

U.S. PATENT DOCUMENTS

2004/0066146 A1 4/2004 Park et al.
2005/0134189 A1 6/2005 Osame et al.
(Continued)

FOREIGN PATENT DOCUMENTS

JP 2007-316511 12/2007
JP 4860699 B2 1/2012
(Continued)

OTHER PUBLICATIONS

EPO Search Report dated Dec. 21, 2015, for corresponding European Patent application 15170821.1, (9 pages).
(Continued)

*Primary Examiner* — Pegeman Karimi
(74) *Attorney, Agent, or Firm* — Lewis Roca Rothgerber Christie LLP

(57) ABSTRACT

A pixel, a display device including a plurality of pixels, and a method of driving the display device. The display device includes: an emission pixel comprising an emission device, the emission pixel being in a display area; a dummy pixel in a non-display area outside the display area; and a repair line that is connectable to the emission device of the emission pixel and the dummy pixel, wherein the dummy pixel includes: a first dummy driver for receiving a same data signal as the data signal applied to the emission pixel for each of a plurality of subfields of one frame and controlling emission of the emission device of the emission pixel via the repair line; and a second dummy driver for resetting the repair line in one of the subfields in which the emission device does not emit light.

24 Claims, 15 Drawing Sheets

(51) Int. Cl.

| | |
|---|---|
| ***G09G 3/3291*** | (2016.01) |
| ***G09G 3/3233*** | (2016.01) |
| *G09G 3/20* | (2006.01) |

(52) U.S. Cl.

CPC ... *G09G 3/2022* (2013.01); *G09G 2300/0413* (2013.01); *G09G 2300/0426* (2013.01); *G09G 2300/0852* (2013.01); *G09G 2300/0861* (2013.01); *G09G 2310/0251* (2013.01); *G09G 2310/0262* (2013.01); *G09G 2320/0666* (2013.01); *G09G 2330/08* (2013.01)

(56) References Cited

U.S. PATENT DOCUMENTS

| | | | | |
|---|---|---|---|---|
| 2005/0259093 | A1 | 11/2005 | Osame et al. | |
| 2008/0036386 | A1 | 2/2008 | Shin et al. | |
| 2010/0044691 | A1 | 2/2010 | Hong et al. | |
| 2012/0146990 | A1 | 6/2012 | Kim | |
| 2013/0293526 | A1* | 11/2013 | Igawa | G09G 3/3696 345/212 |
| 2014/0346475 | A1* | 11/2014 | Cho | H01L 27/326 257/40 |
| 2014/0347401 | A1* | 11/2014 | Hwang | G09G 3/3233 345/690 |

FOREIGN PATENT DOCUMENTS

| | | | |
|---|---|---|---|
| KR | 10-0740133 | B1 | 7/2007 |
| KR | 10-0932989 | B1 | 12/2009 |
| KR | 10-2010-0070857 | A | 6/2010 |
| KR | 10-2012-0065138 | A | 6/2012 |
| KR | 10-2014-0137272 | A | 12/2014 |

OTHER PUBLICATIONS

English machine translation of p. 5, paragraph 12, and p. 10, paragraphs 58 thru 60, of Japanese Publication 2007-316511 dated Dec. 6, 2007, (2 pages).

* cited by examiner

PIXEL, DISPLAY DEVICE INCLUDING THE PIXEL, AND METHOD OF DRIVING THE DISPLAY DEVICE

CROSS-REFERENCE TO RELATED APPLICATION

This application claims priority to and the benefit of Korean Patent Application No. 10-2014-0071070, filed on Jun. 11, 2014, in the Korean Intellectual Property Office, the disclosure of which is incorporated herein in its entirety by reference.

BACKGROUND

1. Field

One or more embodiments of the present invention relate to a pixel, a display device including a plurality of pixels, and a method of driving the display device.

2. Description of the Related Art

If a pixel in a display device becomes defective, the pixel may emit light all the time regardless of a scan signal and a data signal applied thereto or may be displayed in black (e.g., by not emitting light) all the time. The pixel that emits light all the time is referred to as a bright spot (or a hot spot) and the pixel that is displayed in black all the time is referred to as a dark spot (or a black spot).

As a circuit of the pixel becomes more complex, the bright spot or the dark spot formed by a circuit defect becomes more difficult to fix.

SUMMARY

One or more embodiments of the present invention include a display device for normally driving a defective pixel by repairing the defective pixel, thereby increasing a production yield and improving quality deterioration.

Additional aspects will be set forth in part in the description which follows and, in part, will be apparent from the description, or may be learned by practice of the presented embodiments.

According to one or more embodiments of the present invention, a display device includes: an emission pixel including an emission device, the emission pixel being in a display area; a dummy pixel in a non-display area outside the display area; and a repair line that is connectable to the emission device of the emission pixel and the dummy pixel, wherein the dummy pixel includes: a first dummy driver for receiving a same data signal as the data signal applied to the emission pixel for each of a plurality of subfields of one frame and controlling emission of the emission device of the emission pixel via the repair line; and a second dummy driver for resetting the repair line in a subfield in which the emission device does not emit light among the plurality of subfields.

The second dummy driver may include: a third transistor including a gate electrode connected to a first dummy scan line, a first electrode connected to a dummy data line that applies an inversion signal with respect to the data signal, and a second electrode connected to a second node; and a fourth transistor including a gate electrode connected to the second node, a first electrode connected to the first dummy driver, and a second electrode connected to a second power line.

The second dummy driver may include: a fifth transistor including a gate electrode configured to receive a control signal is applied, a first electrode connected to the first dummy driver, and a second electrode configured to receive a reset signal is applied.

The second electrode of the fifth transistor may be connected to the gate electrode of the fifth transistor to receive the control signal as the reset signal.

The second dummy driver may further include: a sixth transistor including a gate electrode configured to receive the control signal is applied, a first electrode connected to the gate electrode of a second transistor of the first dummy driver, and a second electrode connected to the first electrode of the second transistor of the first dummy driver, wherein the sixth transistor and the fifth transistor are concurrently turned on.

The control signal may turn on the fifth transistor and the sixth transistor in a part of each of the plurality of subfields.

The first dummy driver may include: a first transistor including a gate electrode connected to a first dummy scan line, a first electrode connected to a data line, and a second electrode connected to a first node; a second transistor including a gate electrode connected to the first node, a first electrode configured to be connectable to a first power source, and a second electrode connected to the second dummy driver; and a first dummy capacitor including a first electrode connected to the first node and a second electrode connected to the first electrode of the second transistor.

The second dummy driver may include: a seventh transistor including a gate electrode connected to a second dummy scan line, a first electrode connected to the data line, and a second electrode connected to a second node; an eighth transistor including a gate electrode connected to the second node, a first electrode connected to the first dummy driver, and a second electrode connected to a second power source; and a second dummy capacitor disposed between the gate electrode and the second electrode of the eighth transistor.

A first scan signal applied to the first dummy scan line may precede or follow a second scan signal applied to the second dummy scan line, and wherein the data signal is applied to the data line in response to the first scan signal, and an inversion signal with respect to the data signal is applied to the data line in response to the second scan signal.

The display device may further include: a ninth transistor including a gate electrode connected to a control line, a first electrode connected to a third power source, and a second electrode connected to the gate electrode of the seventh transistor.

The ninth transistor may: be turned on by receiving a test gate signal from the control line when a scan signal is applied from the second dummy scan line; turn off the seventh transistor during a first period; turns on the seventh transistor during a second period; and transfer a voltage having a level to turn off the eighth transistor to the second node.

The display device may further include: a tenth transistor including a gate electrode connected to the control line, a first electrode connected to the third power source, and a second electrode connected to the second electrode of the seventh transistor.

When a scan signal is applied from the second dummy scan line, the ninth transistor is turned on by receiving a test gate signal from the control line to turn off the seventh transistor, and the tenth transistor is turned on by receiving the test gate signal from the control line to turn off the eighth transistor.

The emission device of the emission pixel may be separated from a driver of the emission pixel, and the emission device of the emission pixel and the dummy pixel are connected to the repair line.

According to one or more embodiments of the present invention, a pixel that is connectable to an external pixel via a repair line and enables the external pixel to display gradation by adjusting an emission time of the external pixel according to a data signal supplied to each of a plurality of subfields of one frame, the pixel including: a first transistor including a gate electrode connected to a first scan line, a first electrode connected to a first data line that applies the data signal, and a second electrode connected to a first node; a second transistor including a gate electrode connected to the first node, a first electrode connected to a first power source, and a second electrode connectable to the repair line; a first capacitor including a first electrode connected to the first node and a second electrode connected to the first electrode of the second transistor; and a third transistor connected to the second transistor and connectable to the repair line.

The second transistor and the third transistor may be connected to the repair line so that the pixel is connected to an emission device of the external pixel.

The pixel may further include: a fifth transistor disposed between a gate electrode of the second transistor and the first power source, wherein the fifth transistor and the third transistor are concurrently turned on so that the fifth transistor transfers a voltage having a level to turn off the second transistor to the first node, and wherein the repair line is reset via the third transistor that is turned on.

The third transistor and the fifth transistor may be turned on during a part of each of the plurality of subfields.

The second transistor may be turned off and the third transistor is turned on in one of the plurality of subfields in which the external pixel does not emit light, and wherein the repair line is reset via the third transistor that is turned on.

The pixel may further include: a fourth transistor disposed between a gate electrode of the third transistor and a second data line configured to receive an inversion signal with respect to the data signal is applied, wherein the first transistor and the fourth transistor are concurrently turned on.

The pixel may further include: a sixth transistor connected between the first data line and a gate electrode of the third transistor; and a second capacitor including a first electrode connected to the gate electrode of the third transistor and a second electrode connected to a second power source, wherein the sixth transistor is turned on before or after the first transistor, wherein the data signal is applied to the first data line when the first transistor is turned on, and wherein an inversion signal with respect to the data signal is applied to the first data line when the sixth transistor is turned on.

The pixel may further include: a seventh transistor disposed between the gate electrode of the sixth transistor and a third power source.

The pixel may further include: an eighth transistor disposed between a gate electrode of the third transistor and the third power source.

According to one or more embodiments of the present invention, a method of driving a display device including an emission pixel and a dummy pixel, the emission pixel being connected to the dummy pixel via a repair line, the method including: controlling, by the dummy pixel, emission of an emission device of the emission pixel via the repair line, and adjusting an emission time of the emission device of the emission pixel to display gradation by the emission pixel, according to a data signal applied to the dummy pixel for each of a plurality of subfields of one frame, and resetting, by the dummy pixel, the repair line in one of the subfields in which the emission device does not emit light.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
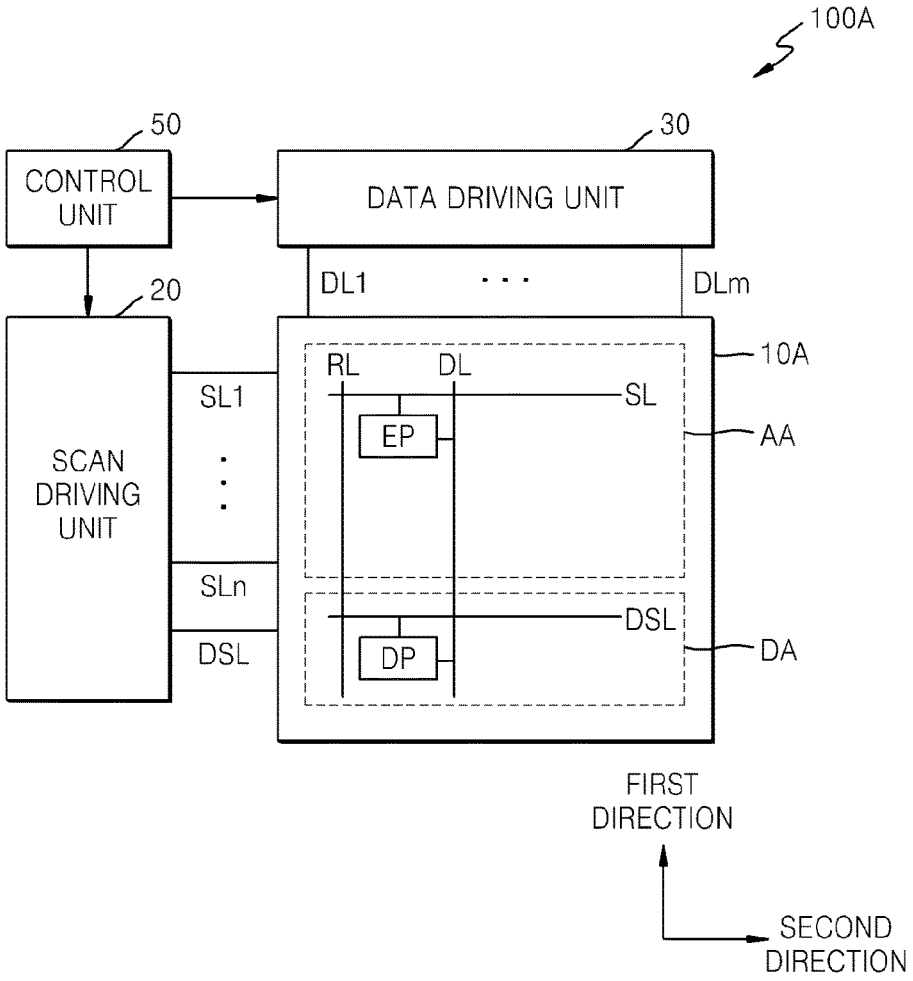
FIG. 1 is a schematic block diagram of a display device according to an embodiment of the present invention.

Reference will now be made in detail to embodiments, examples of which are illustrated in the accompanying drawings, wherein like reference numerals refer to like elements throughout. The present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items.

In the accompanying drawings, those components that are the same or are in correspondence are rendered the same reference numeral regardless of the figure number, and redundant explanations are omitted.

Throughout the specification, while terms "first" and "second" are used to describe various components, it is obvious that the components are not limited to the terms "first" and "second". The terms "first" and "second" are used only to distinguish between each component. Throughout the specification, the singular form may include the plural form, unless there is a particular description contrary thereto.

Expressions such as "at least one of," when preceding a list of elements, modify the entire list of elements and do not modify the individual elements of the list. Further, the use of "may" when describing embodiments of the present invention refers to "one or more embodiments of the present invention."

When a first element is described as being "coupled" or "connected" to a second element, the first element may be directly "coupled" or "connected" to the second element, or one or more other intervening elements may be located between the first element and the second element.

Also, terms such as "comprise" or "comprising" are used to specify existence of a recited form, and/or a component, not excluding the existence of one or more other recited forms, and/or one or more other components.

FIG. 1 is a schematic block diagram of a display device 100A according to an embodiment of the present invention.

Referring to FIG. 1, the display apparatus 100A according to an embodiment of the present invention includes a display panel 10A including a plurality of pixels arranged in rows and columns, a scan driving unit 20 (e.g., a scan driver 20), a data driving unit 30 (e.g., a data driver 30), and a control unit 50 (e.g., a controller 50).

The display panel 10A may include an insulating substrate (hereinafter referred to as a "substrate") on which a plurality of scan lines SL1 through SLn and DSL, a plurality of data lines DL1 through DLm, a plurality of emission pixels EP and a plurality of dummy pixels DP that are connected to the scan lines SL1 through SLn and DSL and the data lines DL1 through DLm, and a facing substrate that faces the substrate and is bonded to the substrate are disposed.

The scan driving unit 20, the data driving unit 30, and the control unit 50 may be formed as separate integrated circuit chips or one integrated circuit chip and may be mounted directly on the substrate of the display panel 10A, or mounted on a flexible printed circuit film, or attached to the substrate of the display panel 10A in a tape carrier package (TCP), or mounted on a separate printed circuit board (PCB), or may be formed on the substrate of the display panel 10A.

A display area AA and a dummy area DA may be formed on the substrate of the display panel 10A. The dummy area DA is a part of a non-display area around the display area AA.

The dummy area DA may be disposed in at least one of upper and lower sides or left and right sides of the display area AA. The plurality of dummy pixels DP may be formed in each pixel column in at least one of upper and lower areas of a pixel column or may be formed in each pixel row in at least one of left and right areas of a pixel row. An example of forming the dummy pixels DP in the pixel column of the dummy area DA of the upper and lower sides of the display area AA will be described in FIG. 1. However, FIG. 1 may also disclose a case where the dummy pixels DP are formed in the pixel row of the dummy area DA of the left and right sides of the display area AA.

The emission pixels EP that are connected to the scan lines SL1 through SLn and the data lines DL1 through DLm are arranged on the substrate of the display area AA. The dummy pixels DP that are connected to a dummy scan line DSL and the data lines DL1 through DLm are arranged in the dummy area DA. The scan lines SL1 through SLn may extend in a first direction. The data lines DL1 through DLm may extend in a second direction.

The emission pixels EP may display one color and may display one of, for example, red, green, blue, and white. However, the present invention is not limited thereto, and the emission pixels EP may display a color other than red, green, blue, and white.

The dummy pixels DP may be provided in each column in a row direction. The dummy scan line DSL may be at least one scan line disposed after the last nth scan line SLn of the display area AA and/or may be at least one scan line disposed before the first scan line SL1 of the display area AA.

The substrate of the display panel 10A may include a plurality of repair lines RL Rl1 through RLm. The repair lines RL may be formed in parallel to the data lines DL1 through DLm. The repair lines RL may be disposed to be connectable to the dummy pixels DP and emission devices of the emission pixels EP in the same column.

In the present specification, the term "connectable" or "connectably" refers to a connectable state obtained by using a laser during a repair process. When a first member and a second member are referred to as being connectably disposed, the first and second members are in a connectable state during the repair process while the first and second members are not actually connected to each other. For example, the first and second members that are "connectable" to each other may be disposed to overlap each other with an insulating layer disposed therebetween in an overlapping area. When laser is irradiated on the overlapping area during the repair process, the insulating layer is destructed in the overlapping area, and the first and second members are electrically coupled (e.g., electrically connected) to each other.

If one of the emission pixels EP is defective, the repair line RL may be used to connect the emission device, which may be separated from the defective pixel EP, to a dummy pixel DP, to provide a path for controlling emission of the defective pixel EP according to logic levels of dummy data signals applied to the dummy pixel DP.

Hereinafter, a defective pixel repaired through a repair process is referred to as a repair pixel. The repair process may be performed after a cell process of forming pixel circuit array and emission devices on a substrate.

Although the data line DL is disposed at a right side of the emission pixel EP and the dummy pixel DP, and the repair line RL is disposed at a left side thereof in FIG. 1, the present invention is not limited thereto. The positions of the data line DL and the repair line RL may be switched. Alternatively, both the data line DL and the repair line RL may be disposed at the left or right side of the emission pixel EP and the dummy pixel DP. One or more repair lines RL may be formed in each pixel column. The one or more repair lines RL may be formed in parallel to the scan lines SL according to a pixel design so that the one or more repair lines RL may be formed in each pixel row.

The scan driving unit 20 may generate and sequentially provide scan signals via the scan lines SL1 through SLn and the dummy scan line DSL to the display panel 10A at determined timing.

When the scan signals are applied to the emission pixels EP, the data driving unit 20 provides a data signal having one of a first logic level and a second logic level to each of the emission pixels EP of the display panel 10A via the data lines DL1 through DLm. The first logic level and the second logic level may be respectively a high level and a low level. Alternatively, the first logic level and the second logic level may be respectively the low level and the high level.

The data driving unit 30 may receive image data of one frame with respect to the emission pixels EP, extract gradation for each of the emission pixels EP, and convert the extracted gradation into digital data of a previously determined number of bits. The data driving unit 30 may provide each bit included in the digital data to a corresponding one of the data lines DL1 through DLm 30 as a data signal for each corresponding subfield. One frame is composed of a plurality of subfields of which display time (e.g., display continuation time or display continuation) is determined according to a set weight.

In the display device 100A, the emission device included in each of the emission pixels EP emits light selectively based on a logic level of the data signal provided from the data driving unit 30 for each subfield, and an emission time of the emission device is adjusted within one frame, thereby displaying gradation. Each of the emission pixels EP may make the emission device emit light during a corresponding subfield section when the data signal of the low level is received, and may turn off the emission device during the corresponding subfield section when the data signal of the high level is received. Alternatively, when the data signal of the high level is received, each of the emission pixels EP may make the emission device emit light during the corresponding subfield section, and when the data signal of the low level is received, each of the emission pixels EP may turn off the emission device during the corresponding subfield section.

Although an example in which the scan driving unit 20 applies the scan signals to the dummy pixels DP is illustrated in FIG. 1, a separate dummy driving unit (e.g., a dummy driver) may apply the scan signals to the dummy pixels DP. Although one scan driving unit 20 is illustrated in FIG. 1, the scan driving units (e.g., scan drivers) 20 may be provided at both sides of the scan lines SL1 through SLn, and thus a voltage drop of the scan signals that are far away from the scan driving unit 20 may be reduced or minimized.

When the scan signals are applied to the dummy pixels DP, the data driving unit 30 may apply dummy data signals to the dummy pixels DP.

During normal driving when the data signals are directly applied to the emission pixels EP, the data driving unit 30 may apply a data signal that has been applied or is to be applied to the emission pixel EP that is connected to the first scan line SL1 or the last scan line SLn of the display area AA to the dummy pixel DP as a dummy data signal. During repair driving when the data signals are directly applied to the repair pixel from the dummy pixels DP via the repair lines RL, the data driving unit 30 may apply a data signal that has been applied or is to be applied to the repair pixel to the dummy pixel DP as the dummy data signal.

The control unit 50 generates and transmits a scan control signal and a data control signal respectively to the scan driving unit 20 and the data driving unit 30. Accordingly, the scan driving unit 20 applies scan signals to the scan lines SL1 through SLn and the dummy scan line DSL at determined timing, and the data driving unit 30 applies data signals to the emission pixels EP and the dummy pixels DP.

Figure 2:
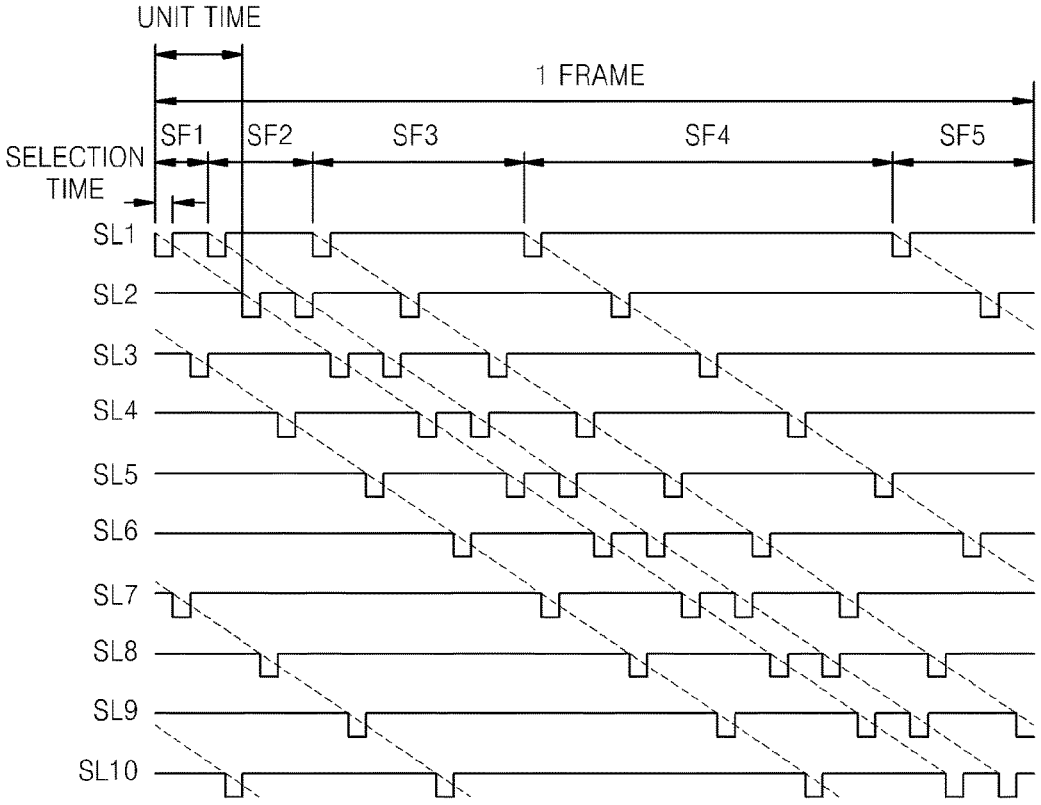
FIGS. 2 and 3 are timing diagrams for explaining a method of driving a display panel of FIG. 1.
Figure 3:
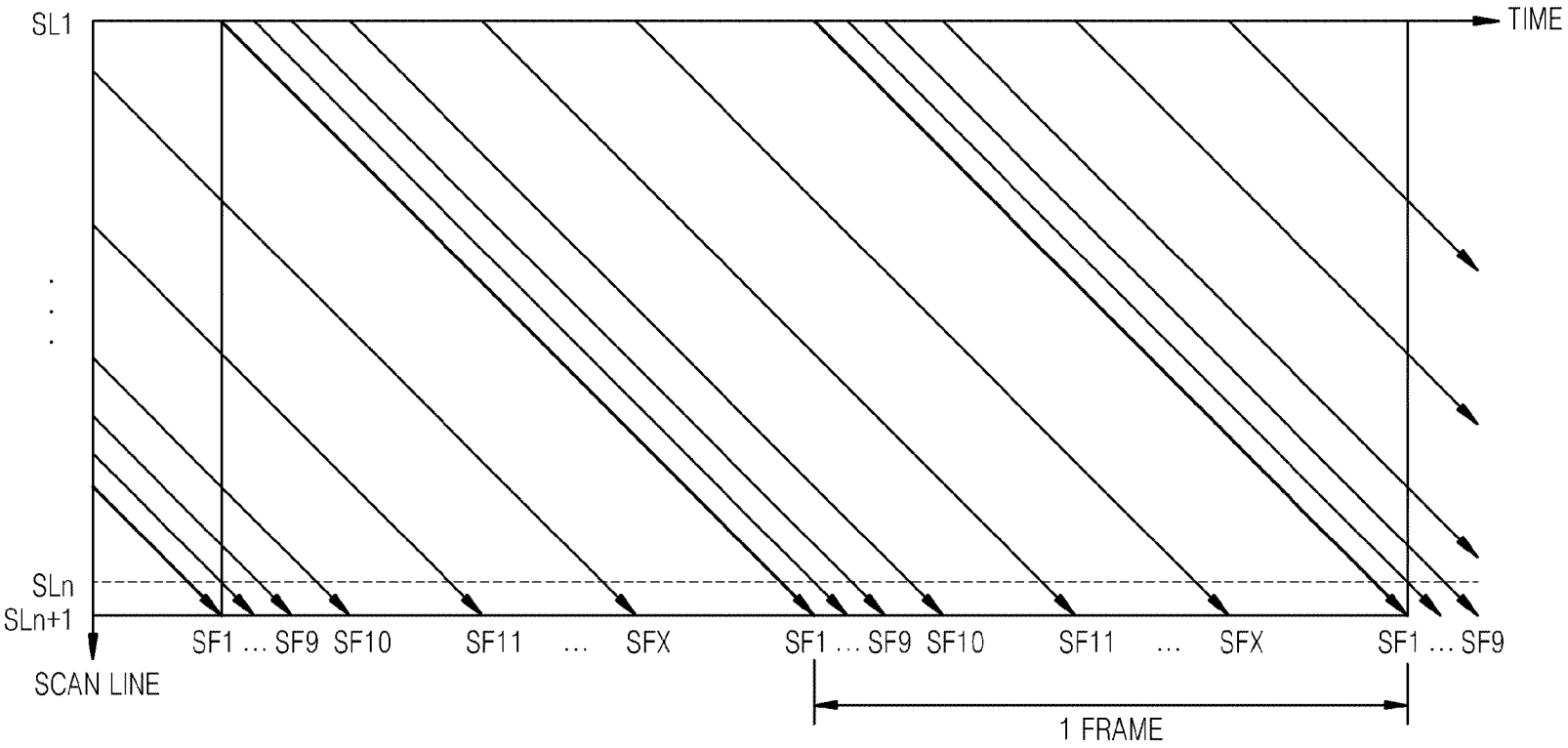

FIGS. 2 and 3 are timing diagrams for explaining a method of driving the display panel 10A of FIG. 1.

FIG. 2 is an example timing diagram that illustrates controlling the first through tenth scan lines SL1-SL10. Referring to FIG. 2, one frame is composed of first through fifth subfields SF1 through SF5 and displays gradation by first through fifth bit data. One unit time includes five selection times. A length of display continuation time of each piece of bit data is 3:6:12:21:8. A sum of the display continuation time of the first through fifth bit data is 50 (=3+6+12+21+8) selection times. Selection timing of each scan line SL for each of the first through fifth subfields SF1 through SF5 is delayed by one unit time compared to selection timing of the previous scan line SL.

One unit time is time-divided into five selection times such that only one scan line SL may be selected at one selection time. For example, within a first unit time, the first scan line SL1, the seventh scan line SL7, the third scan line SL3, the first scan line SL1, and the tenth scan line SL10 are sequentially selected at the first through fifth selection times, respectively, and the first bit data, the fourth bit data, the fifth bit data, the second bit data, and the third bit data are applied to the respective emission pixels EP.

The tenth scan line SL10 may be a dummy scan line. When the display panel 10A operates normally, that is, no repair has taken place, and when the tenth scan line SL10 is selected, bit data applied to the emission pixel EP connected to the first scan line SL1 or the ninth scan line SL9 of same pixel column may be applied to the dummy pixel DP of each pixel column.

When the dummy pixel DP connected to the tenth scan line SL10 is used for repair, and when the tenth scan line SL10 is selected, bit data applied to the repair pixel of same pixel column may be applied to the dummy pixel DP.

FIG. 3 is an example timing diagram that illustrates controlling the first through $n+1^{th}$ scan lines SL1 through SLn+1. Referring to FIG. 3, one frame is composed of first through Xth subfields SF1 through SFX and displays gradation by first through Xth bit data. One unit time includes an X number of selection times. Selection timing of each scan line SL for each of the first through Xth subfields SF1 through SFX is delayed by one unit time compared to selection timing of the previous scan line SL. One unit time is equal to X selection times such that only one scan line SL may be selected at one selection time.

The last n+1th scan line SLn+1 may be a dummy scan line. When the display panel 10A operates normally, that is, no repair has taken place, and when the n+1th scan line SLn+1 is selected, bit data applied to the emission pixel EP connected to the first scan line SL1 or the nth scan line SLn of same pixel column may be applied to the dummy pixel DP.

When the dummy pixel DP connected to the n+1th scan line SLn+1 is used for repair, and when the n+1th scan line SLn+1 is selected, bit data applied to the repair pixel of same pixel column may be applied to the dummy pixel DP.

Figure 4:
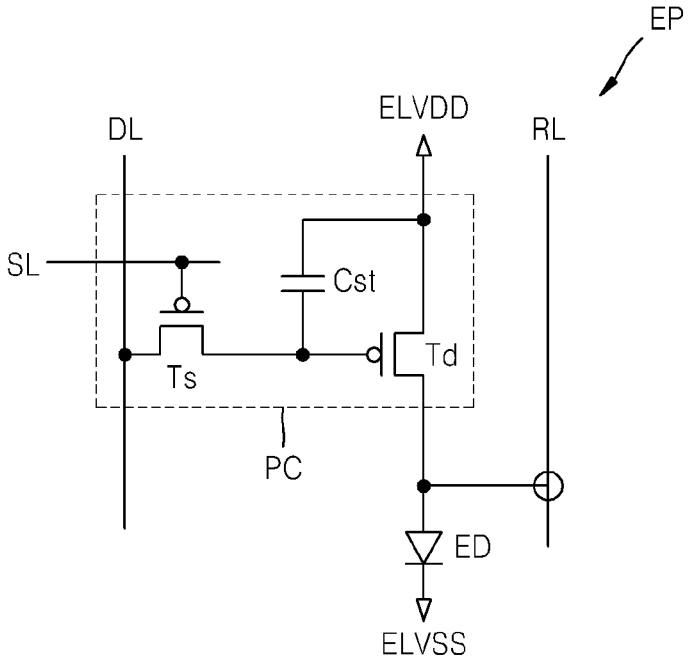
FIG. 4 is a circuit diagram of an emission pixel according to an embodiment of the present invention.

FIG. 4 is a circuit diagram of the emission pixel EP according to an embodiment of the present invention.

Referring to FIG. 4, the emission pixel EP includes a driving unit PC including two transistors Ts and Td and one capacitor Cst, and the emission device ED connected to the driving unit PC. The driving unit PC and the emission device ED may be separably connected to each other, and may be separated from each other during a repair process.

In the present specification, the terms "separable" and "separably" refer to a separable state obtained by using a laser during a repair process. When a first member and a second member are referred to as being separably disposed, the first and second members are in a separable state during the subsequent repair process, while the first and second members are actually connected to each other. For example, the first and second members that are "separably" connected to each other may be connected to each other via a conductive connection member. When laser is irradiated on the conductive connection member during the repair process, a part of the conductive connection member on which laser is irradiated is cut, and the first and second members are electrically insulated from each other. As an example, the conductive connection member may include a silicon layer that may be melted by irradiating laser. As another example, the conductive connection member may be melted and cut according to Joule heat generated from a current.

The emission device ED may be an organic light-emitting diode (OLED) including a first electrode, a second electrode facing the first electrode, and an emission layer between the first and second electrodes. The first and second electrodes may be anode and cathode electrodes, respectively. The anode electrode of the emission device ED may be connected to the second electrode of the driving transistor Td, and the cathode electrode thereof may be connected to a second power and receive a second power voltage ELVSS. The anode electrode of the emission device ED may be disposed to be connectable to the repair line RL with an insulating layer disposed therebetween. A first power voltage ELVDD may be a high level voltage (e.g., a predetermined high level voltage). The second power voltage ELVSS may be a voltage lower than the first power voltage ELVDD or may be a ground voltage. The first power voltage ELVDD is transferred to the anode electrode via the driving transistor Td. The emission device ED emits light when the first power voltage ELVDD is applied to the anode electrode, and does not emit light (e.g., displays black) when the first power voltage ELVDD is not applied to the anode electrode.

The switching transistor Ts includes a gate electrode connected to the scan line SL, a first electrode connected to the data line DL, and a second electrode connected to a gate electrode of the driving transistor Td. When the switching transistor Ts is turned on by a scan signal applied to the gate electrode, the switching transistor Ts transfers a data signal applied via the data line DL to the gate electrode of the driving transistor Td.

The driving transistor Td includes a gate electrode connected to the second electrode of the switching transistor Ts, a first electrode connected to the first power and receives the first power voltage ELVDD, and a second electrode connected to the anode electrode of the emission device ED. The driving transistor Td is turned on or off according to a logic level of the data signal applied to the gate electrode, and transfers the first power voltage ELVDD to the anode electrode of the emission device ED when turned on.

The capacitor Cst includes a first electrode that is connected to the second electrode of the switching transistor Ts and the gate electrode of the driving transistor Td, and a second electrode that is connected to the first power and receives the first power voltage ELVDD.

Figure 5:
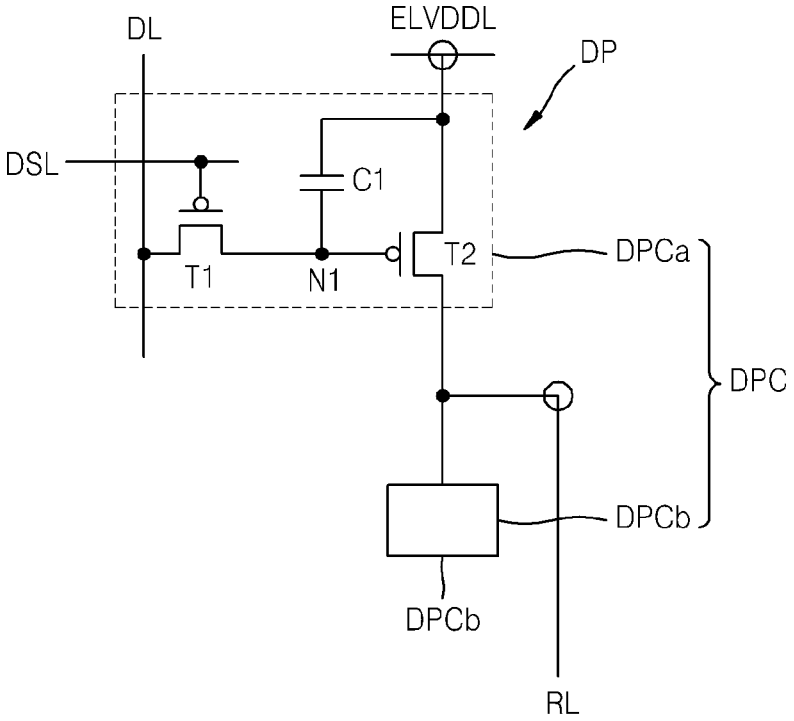
FIG. 5 is a schematic circuit diagram of a dummy pixel according to an embodiment of the present invention.

FIG. 5 is a schematic circuit diagram of the dummy pixel DP according to an embodiment of the present invention.

Referring to FIG. 5, the dummy pixel DP includes a dummy driving unit DPC. The dummy driving unit DPC includes a first dummy driving unit DPCa and a second dummy driving unit DPCb. The repair line RL may be disposed to be connectable to the first dummy driving unit DPCa and the second dummy driving unit DPCb.

When the first dummy driving unit DPCa is connected to the repair line RL by a repair process, the first dummy driving unit DPCa is a circuit unit that receives a data signal which is the same or substantially the same as that applied to the repair pixel and controls emission of an emission device of the repair pixel via the repair line RL according to the data signal. The first dummy driving unit DPCa may be activated in a subfield (hereinafter referred to as an "emission subfield") in which the emission device emits light, output a driving current to the repair line RL, and transfer a first power voltage to an anode of the emission device of the repair pixel EPrrs.

The first dummy driving unit DPCa may include a first transistor T1, a second transistor T2, and a first capacitor C1.

The first transistor T1 includes a gate electrode connected to the dummy scan line DSL, a first electrode connected to the data line DL, and a second electrode connected to a first node N1.

The second transistor T2 includes a gate electrode connected to the first node N1, a first electrode disposed to be connectable to a first power line ELVDDL with an insulating layer therebetween, and a second electrode connected to the second dummy driving unit DPCb and disposed to be connectable to the repair line RL with the insulating layer therebetween. The first electrode of the second transistor T2 may be disposed to be connectable to a plurality of first power lines ELVDDL that apply different first power voltages according to a color displayed by the emission pixel EP.

The first capacitor C1 includes a first electrode connected to the first node N1 and a second electrode connected to the first electrode of the second transistor T2. The first capacitor C1 may be charged with a voltage corresponding to a data signal transferred via the first transistor T1.

The second dummy driving unit DPCb is a circuit unit that is activated in a subfield (hereinafter referred to as a "non-emission subfield") in which the emission device does not emit light and resets (discharges) the repair line RL. Various embodiments of the second dummy driving unit DPCb will be described later.

Figure 6:
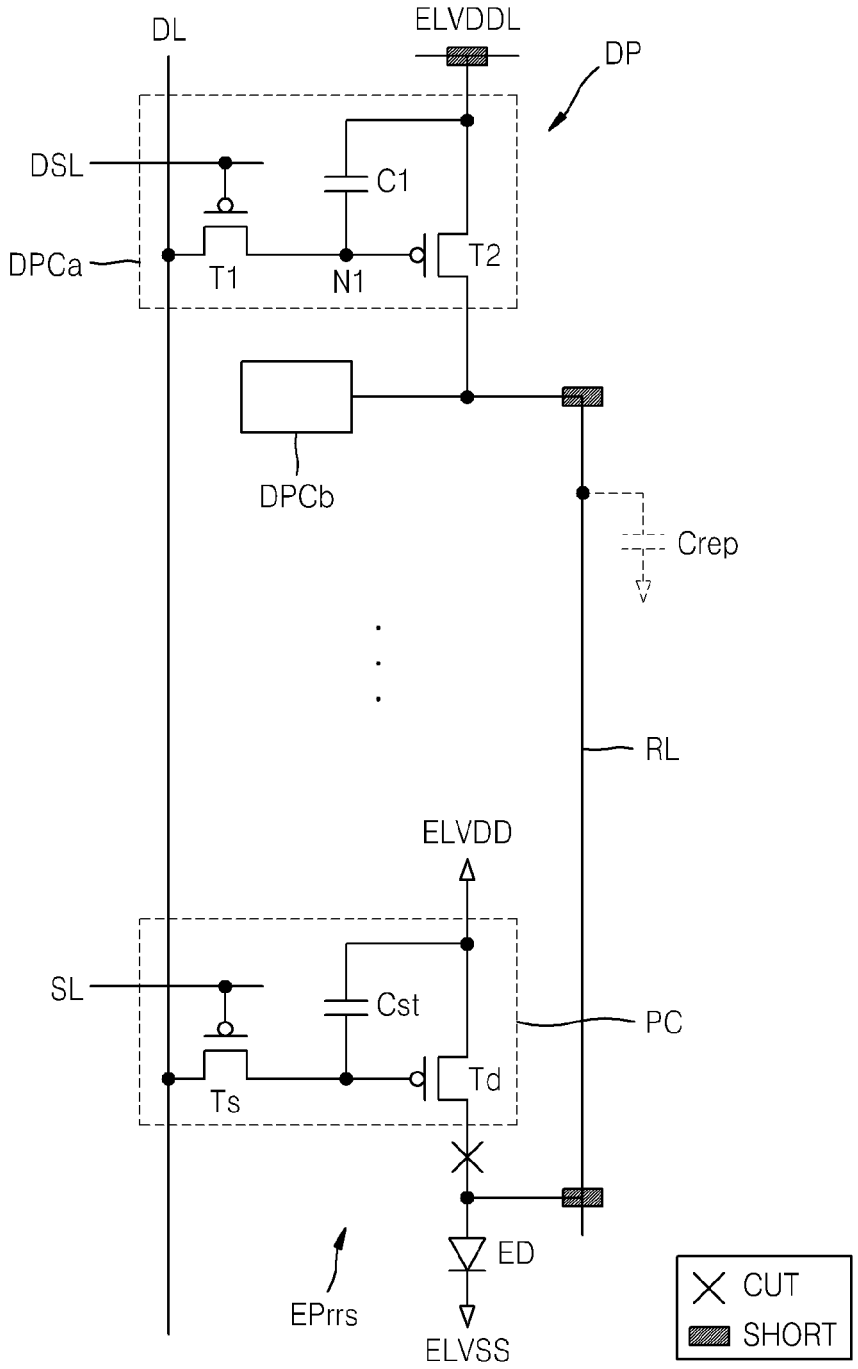
FIG. 6 is a circuit diagram for explaining a method of repairing a defective pixel according to an embodiment of the present invention.

FIG. 6 is a circuit diagram for explaining a method of repairing a defective pixel according to an embodiment of the present invention.

Referring to FIG. 6, the driving unit PC of a defective pixel EPerr (e.g., EPrrs prior to a repair process being performed) may be separated from the emission device ED in a separation area by performing the repair process. The separation area is an area in which laser is irradiated so as to separate the separably connected members during the repair process. For example, a connection of an anode electrode of the emission device ED and the driving transistor Td is cut by irradiating the laser onto a part of an area to which the anode electrode of the emission device ED and a second electrode of the driving transistor Td are connected, thereby separating the driving unit PC and the emission device ED. The separated emission device ED may be electrically connected to the repair line RL by irradiating the laser onto an overlapping area between a conductive member connected to the anode electrode and the repair line RL.

A first electrode of the second transistor T2 of the dummy pixel DP may be connected to the first power line ELVDDL, from among the plurality of first power lines ELVDDL, and which applies a first power voltage corresponding to a color displayed by the repair pixel EPrrs. For example, the first electrode of the second transistor T2 and the first power line ELVDDL may be electrically connected by irradiating the laser onto an overlapping area between the first electrode of the second transistor T2 and the first power line ELVDDL.

A second electrode of the second transistor T2 may be electrically connected to the repair line RL. For example, the dummy driving unit DPC and the repair line RL may be electrically connected by irradiating the laser onto an overlapping area between a conductive member that is connected to the second electrode of the second transistor T2 and the second dummy driving unit DPCb and the repair line RL.

The first transistor T1 transfers a dummy data signal supplied to the data line DL to a gate electrode of the second transistor T2 connected to the first node N1 when the first transistor T1 is turned on by a scan signal applied to the gate electrode in each subfield. The dummy data signal the same or substantially the same as is a data signal applied to the repair pixel EPrrs.

The second transistor T2 may be turned on or off according to a logic level of the data signal applied to the gate electrode, and when turned on, may output a driving current corresponding to the data signal to the repair line RL. Accordingly, an emission device of the repair pixel EPrrs emits or does not emit light in each subfield by the dummy pixel DP to adjust an emission time, thereby displaying a determined gradation.

Figure 7:
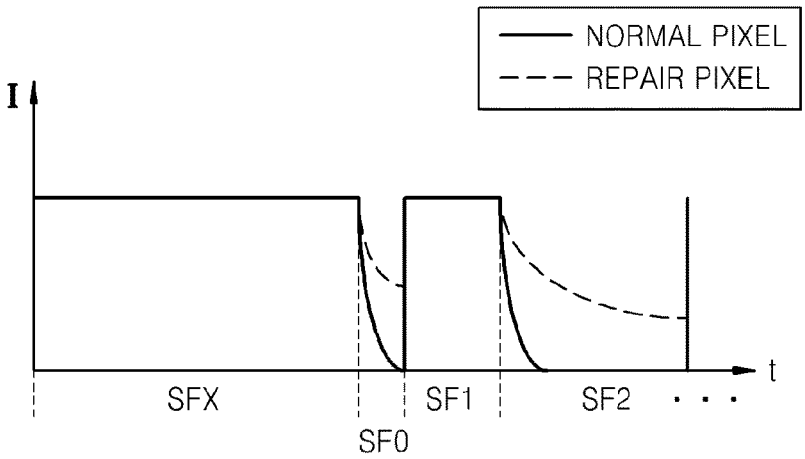
FIG. 7 is a graph for explaining an off current that flows through an emission device of a normal emission pixel and an off current that flows through an emission device of a repair pixel over time.

FIG. 7 is a graph for explaining an off current that flows through an emission device of a normal emission pixel and an off current that flows through an emission device of a repair pixel over time.

In the normal emission pixel, as indicated in a solid line of FIG. 7, the emission device is quickly reset in a non-emission subfield (for example, SF0, SF2, etc.) so that current I of the emission device quickly reaches an off level, and thus the emission device displays black.

In the repair pixel, as indicated in a dotted line of FIG. 7, a discharge time is increased due to a parasitic capacitor Crep of the repair line RL, and thus, the emission device and the repair line RL are not sufficiently reset (discharged) in the non-emission subfield. Accordingly, the current I of the emission device does not reach the off level in the non-emission subfield, and thus, the repair pixel may be visibly recognized brighter than adjacent normal pixels. Such a phenomenon becomes further serious when the emission time (a display continuation time) of a subfield is short.

Therefore, a discharge path for the repair line RL is provided by using the dummy pixel DP in the non-emission subfield according to the embodiment of the present invention, and thus the current I of the emission device of the repair pixel quickly reaches the off level in the non-emission subfield, and thus the emission device displays black.

Figure 8:
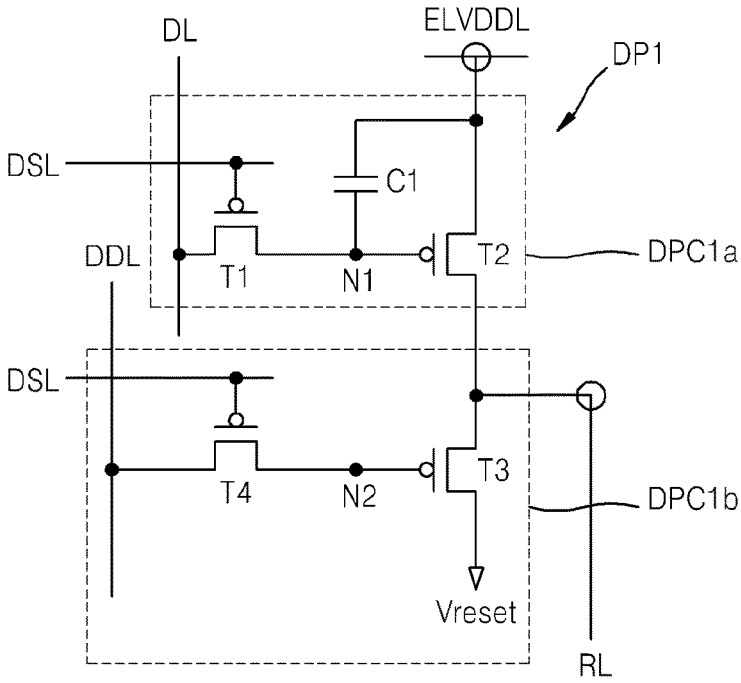
FIGS. 8, 9, 10, and 11 are circuit diagrams of dummy pixels according to embodiments of the present invention.

FIG. 8 is a circuit diagram of a dummy pixel DP1 according to another embodiment of the present invention.

Referring to FIG. 8, the dummy pixel DP1 may include a first dummy driving unit DPC1*a* and a second dummy driving unit DPC1*b*. The first dummy driving unit DPC1*a* is the same or substantially the same as the first dummy driving unit DPCa of FIG. 5, and thus a detailed description thereof will not be repeated.

The second dummy driving unit DPC1*b* may include a third transistor T3 and a fourth transistor T4.

The third transistor T3 may include a gate electrode connected to a second node N2, a first electrode that is connected to a second electrode of the second transistor T2 and is connectable to the repair line RL, and a second electrode that is connected to a reset power line which is supplied with a reset voltage Vreset. The reset voltage Vreset may be the second power voltage ELVSS or a ground voltage. The third transistor T3 may be turned on or off according to a voltage level of the gate electrode.

The fourth transistor T4 may include a gate electrode connected to the dummy scan line DSL, a first electrode connected to a dummy data line DDL, and a second electrode connected to the second node N2. An inversion signal with respect to the data signal applied to the data line DL is applied to the dummy data line DDL. The fourth transistor T4 transfers the inversion signal supplied to the dummy data line DDL to the gate electrode of the third transistor T3 connected to the second node N2 when the fourth transistor T4 is turned on in response to a scan signal applied to the gate electrode from the dummy scan line DSL, thereby controlling the third transistor T3 to be turned on and off.

When the dummy pixel DP1 is connected to the first power line ELVDDL and the repair line RL by a repair process, the dummy pixel DP1 may control driving of the repair pixel EPrrs.

When the scan signal is applied to the dummy scan line DSL for each subfield, the first transistor T1 and the fourth transistor T4 are concurrently (e.g., simultaneously) turned on. The first transistor T1 transfers the data signal applied to the data line DL to the first node N1. The first capacitor C1 is charged with a voltage corresponding to the data signal. The fourth transistor T4 transfers the inversion signal of the data signal applied to the data line DDL to the second node N2.

In an emission subfield, the data signal has a low level, and the second transistor T2 is turned on by the data signal of the first node N1. The second transistor T2 that is turned on outputs a current to the repair line RL and transfers the first power voltage ELVDD to the anode electrode of the emission device ED of the repair pixel EPrrs. The third transistor T3 may be turned off by an inversion signal of the second node N2 to block (e.g., electrically disconnected or electrically isolate) the reset power line from the repair line RL.

In a non-emission subfield, the data signal has a high level, and the second transistor T2 is turned off by the data signal of the first node N1. The third transistor T3 is turned on by the inversion signal of the second node N2 and provides a discharge path for the repair line RL, thereby resetting the repair line RL.

Figure 9:
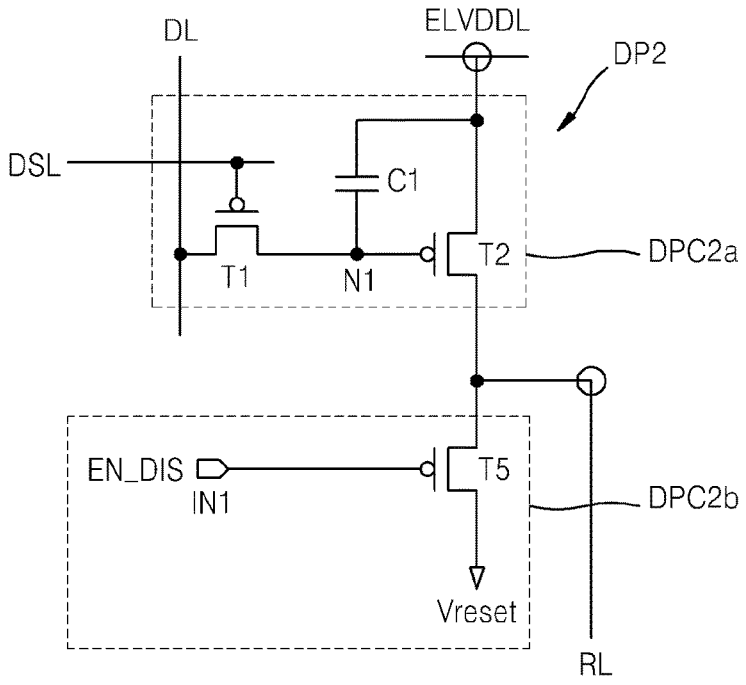

FIG. 9 is a circuit diagram of a dummy pixel DP2 according to another embodiment of the present invention.

Referring to FIG. 9, the dummy pixel DP2 may include a first dummy driving unit DPC2*a* and a second dummy driving unit DPC2*b*. The first dummy driving unit DPC2*a* is the same or substantially the same as the first dummy driving unit DPCa of FIG. 5, and thus a detailed description thereof will not be repeated.

The second dummy driving unit DPC2*b* may include a fifth transistor T5.

The fifth transistor T5 may include a gate electrode connected to a first control terminal IN1, a first electrode that is connected to a second electrode of the second transistor T2 and is connectable to the repair line RL, and a second electrode that is connected to a reset power line which is supplied with the reset voltage Vreset. The reset voltage Vreset may be the second power voltage ELVSS or a ground voltage. The fifth transistor T5 may be turned on or off by a first control signal EN_DIS applied to the first control terminal IN1.

When the dummy pixel DP2 is connected to the first power line ELVDDL and the repair line RL by performing a repair process, the dummy pixel DP2 may control driving of the repair pixel EPrrs.

When a scan signal is applied to the dummy scan line DSL for each subfield, the first transistor T1 is turned on. The first transistor T1 transfers a data signal applied to the data line DL to the first node N1. The first capacitor C1 is charged with a voltage corresponding to the data signal.

In an emission subfield, the data signal has a low level, and the second transistor T2 is turned on by the data signal of the first node N1. The second transistor T2 that is turned on outputs a current to the repair line RL and transfers the first power voltage ELVDD to the anode electrode of the emission device ED of the repair pixel EPrrs. The first control signal EN_DIS that turns off the fifth transistor T5 is applied to the first control terminal IN1 of the fifth transistor T5. Accordingly, the fifth transistor T5 may be turned off to block (e.g., electrically disconnected or electrically isolate) the reset power line from the repair line RL.

In a non-emission subfield, the data signal has a high level, and the second transistor T2 is turned off by the data signal of the first node N1. The first control signal EN_DIS that turns on the fifth transistor T5 is applied to the first control terminal IN1 of the fifth transistor T5. Accordingly, the fifth transistor T5 is turned on and provides a discharge path for the repair line RL, thereby resetting the repair line RL. The fifth transistor T5 may adjust a slew rate of the first control signal EN_DIS to adjust a discharge time of the repair line RL.

Figure 10:
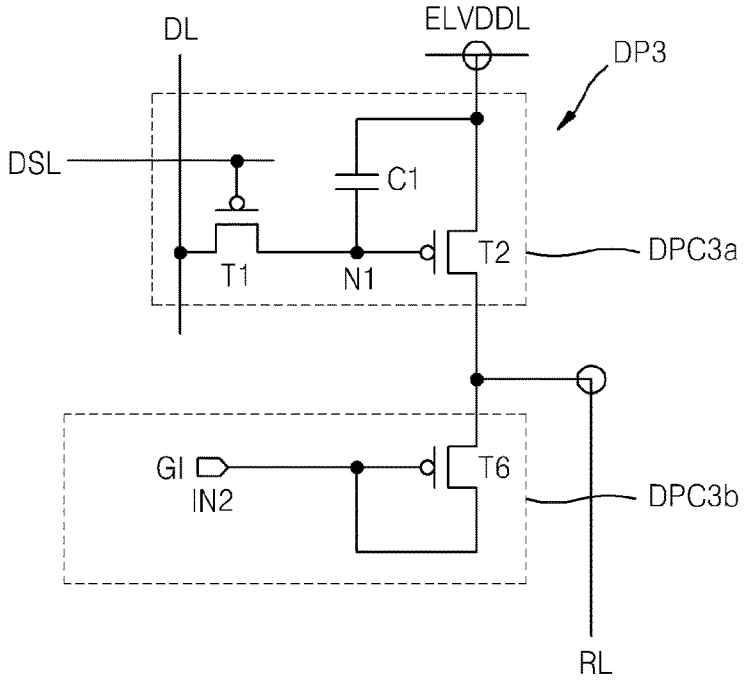

FIG. 10 is a circuit diagram of a dummy pixel DP3 according to another embodiment of the present invention.

Referring to FIG. 10, the dummy pixel DP3 may include a first dummy driving unit DPC3*a* and a second dummy driving unit DPC3*b*. The first dummy driving unit DPC3*a* is the same or substantially the same as the first dummy driving unit DPCa of FIG. 5, and thus a detailed description thereof will not be repeated.

The second dummy driving unit DPC3*b* may include a sixth transistor T6.

The sixth transistor T6 may include a gate electrode and a second electrode connected to a second control terminal IN2, and a first electrode that is connected to a second electrode of the second transistor T2 and is connectable to the repair line RL. The sixth transistor T6 may be turned on or off by a second control signal GI applied to the second control terminal IN2.

When the dummy pixel DP3 is connected to the first power line ELVDDL and the repair line RL by performing a repair process, the dummy pixel DP3 may control driving of the repair pixel EPrrs.

When a scan signal is applied to the dummy scan line DSL for each subfield, the first transistor T1 is turned on. The first transistor T1 transfers a data signal applied to the data line DL to the first node N1. The first capacitor C1 is charged with a voltage corresponding to the data signal.

In an emission subfield, the data signal has a low level, and the second transistor T2 is turned on by the data signal of the first node N1. The second transistor T2 that is turned on outputs a current to the repair line RL and transfers the first power voltage ELVDD to the anode electrode of the emission device ED of the repair pixel EPrrs. The second control signal GI that turns off the sixth transistor T6 is applied to the second control terminal IN2 of the sixth transistor T6. Accordingly, the sixth transistor T6 may be turned off to block (e.g., electrically disconnected or electrically isolate) the second dummy driving unit DPC3*b* from the repair line RL.

In a non-emission subfield, the data signal has a high level, and the second transistor T2 is turned off by the data signal of the first node N1. The second control signal GI that turns on the sixth transistor T6 is applied to the second control terminal IN2 of the sixth transistor T6. Accordingly, the sixth transistor T6 is turned on and provides a discharge path for the repair line RL, thereby resetting the repair line RL. The sixth transistor T6 may adjust a slew rate of the second control signal GI to adjust a discharge time of the repair line RL.

Figure 11:
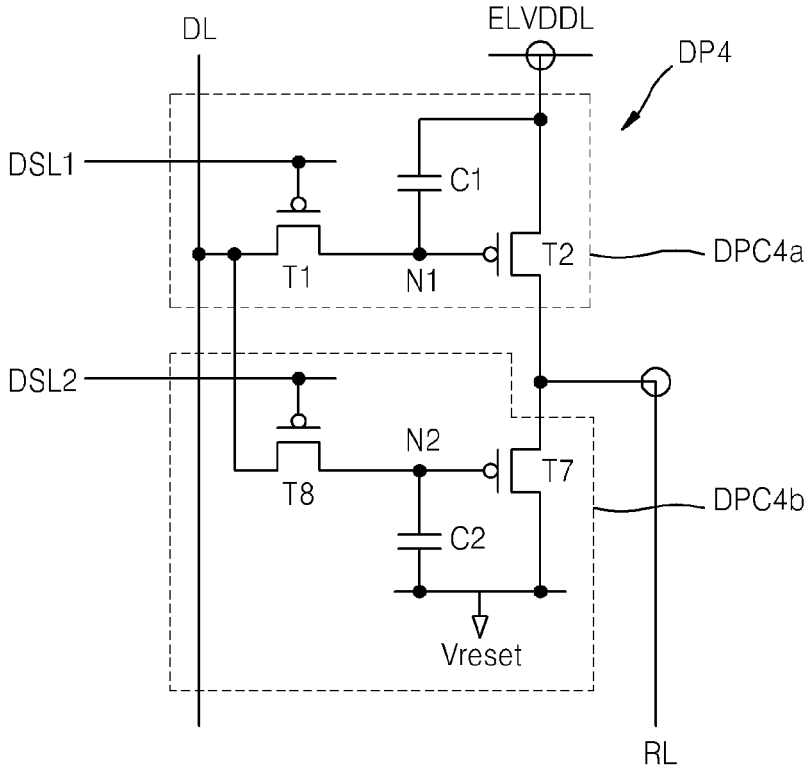
Figure 12A:
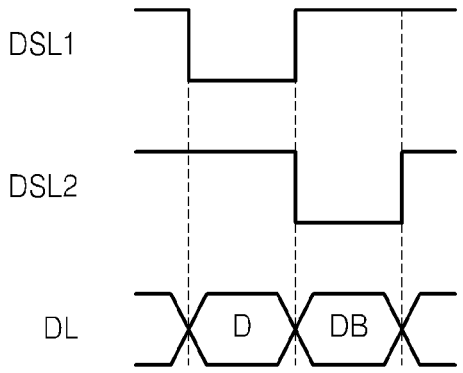
FIGS. 12A and 12B are timing diagrams for explaining a method of driving a display panel of FIG. 11.
Figure 12B:
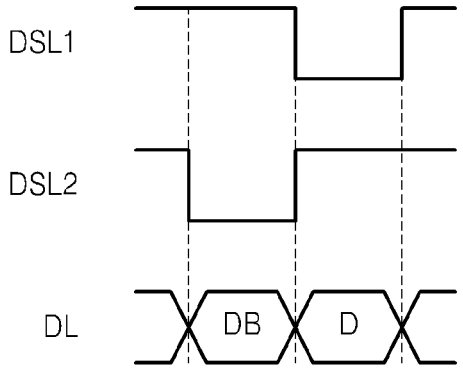

FIG. 11 is a circuit diagram of a dummy pixel DP4 according to another embodiment of the present invention. FIGS. 12A and 12B are driving timing diagrams of the dummy pixel DP4 of FIG. 11.

Referring to FIG. 11, the dummy pixel DP4 may include a first dummy driving unit DPC4*a* and a second dummy driving unit DPC4*b*. The first dummy driving unit DPC4*a* is the same or substantially the same as the first dummy driving unit DPCa of FIG. 5, except that a gate electrode of the first transistor T1 of the first dummy driving unit DPC4*a* is connected to a first dummy scan line DSL1, and thus a detailed description thereof will not be repeated.

The second dummy driving unit DPC4*b* may include a seventh transistor T7, an eighth transistor T8, and a second capacitor C2.

The seventh transistor T7 may include a gate electrode connected to the second node N2, a first electrode that is connected to a second electrode of the second transistor T2 and is connectable to the repair line RL, and a second electrode that is connected to a reset power line, the reset power line being supplied with the reset voltage Vreset. The reset voltage Vreset may be the second power voltage ELVSS or a ground voltage. The seventh transistor T7 may be turned on or off according to a voltage level of the gate electrode.

The eighth transistor T8 may include a gate electrode connected to a second dummy scan line DSL2, a first electrode connected to the data line DL, and a second electrode connected to the second node N2. The second dummy scan line DSL2 may be a previous or next scan line of the first dummy scan line DSL1. The eighth transistor T8 transfers a signal supplied from the data line DL to the gate electrode of the seventh transistor T7 connected to the second node N2 when the eighth transistor T8 is turned on in response to a scan signal applied to the gate electrode from the second dummy scan line DSL2, thereby controlling the seventh transistor T7 to be turned on and off.

The second capacitor C2 may include a first electrode connected to the gate electrode of the seventh transistor T7 and a second electrode connected to the reset power line and supplying the reset voltage Vreset.

When the dummy pixel DP4 is connected to the first power line ELVDDL and the repair line RL by performing a repair process, the dummy pixel DP4 may control driving of the repair pixel EPrrs.

A first scan signal and a second scan signal are sequentially applied to the first dummy scan line DSL1 and the second dummy scan line DSL2 for each subfield. The first transistor T1 is turned on by the first scan signal applied to the first dummy scan line DSL1 and transfers a data signal applied from the data line DL to the first node N1. The first capacitor C1 is charged with a voltage corresponding to the data signal. The eighth transistor T8 is turned on by the second scan signal applied to the second dummy scan line DSL2 and transfers an inversion signal with respect to the data signal applied from the data line DL to the second node N2. The second capacitor C2 is charged with a voltage corresponding to the inversion signal.

When the first dummy scan line DSL1 is the previous scan line of the second dummy scan line DSL2, as shown in FIG. 12A, the first scan signal applied to the first dummy scan line DSL1 precedes the second scan signal applied to the second dummy scan line DSL2. When the first dummy scan line DSL1 is the next scan line of the second dummy scan line DSL2, as shown in FIG. 12B, the first scan signal applied to the first dummy scan line DSL1 follows the second scan signal applied to the second dummy scan line DSL2. The data signal D is applied to the data line DL in response to the first scan signal. The inversion signal DB of the data signal is applied the data line DL in response to the second scan line.

In an emission subfield, the data signal has a low level, and the second transistor T2 is turned on by the data signal of the first node N1. The second transistor T2 that is turned on outputs a current to the repair line RL and transfers the first power voltage ELVDD to the anode electrode of the emission device ED of the repair pixel EPrrs. The seventh transistor T7 may be turned off by an inversion signal of the second node N2 to block (e.g., electrically disconnected or electrically isolate) the reset power line from the repair line RL.

In a non-emission subfield, the data signal has a high level, and the second transistor T2 is turned off by the data signal of the first node N1. The seventh transistor T7 is turned on by the inversion signal of the second node N2 and provides a discharge path for the repair line RL, thereby resetting the repair line RL.

Figure 13:
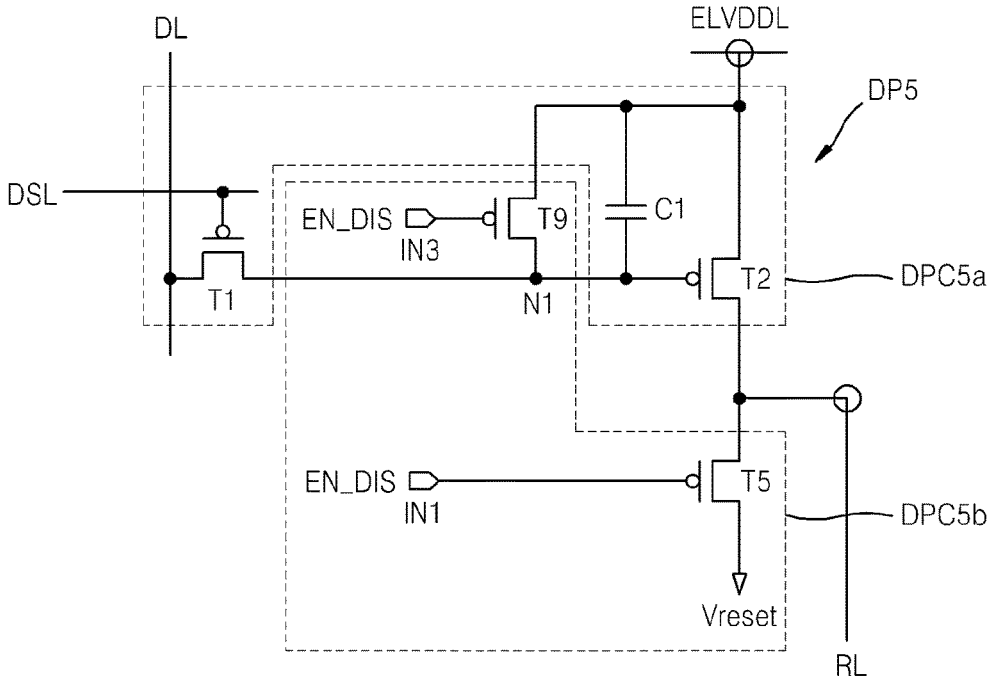
FIGS. 13 and 14 are circuit diagrams of dummy pixels according to embodiments of the present invention.

FIG. 13 is a circuit diagram of a dummy pixel DP5 according to another embodiment of the present invention.

Referring to FIG. 13, the dummy pixel DP5 may include a first dummy driving unit DPC5*a* and a second dummy driving unit DPC5*b*. The dummy pixel DP5 is the same or substantially the same as the dummy pixel DP2 of FIG. 9, except that the dummy pixel DP5 further includes a ninth transistor T9, and turn-on timing of the fifth transistor T5 is different, and thus a detailed description of the same elements will not be repeated.

The second dummy driving unit DPC5*b* may include the fifth transistor T5 and the ninth transistor T9. The ninth transistor T9 may include a gate electrode connected to a third control terminal IN3, a first electrode connected to a first electrode of the second transistor T2, and a second electrode connected to a gate electrode of the second transistor T2.

When the dummy pixel DP5 is connected to the first power line ELVDDL and the repair line RL by performing a repair process, the dummy pixel DP5 may control driving of the repair pixel EPrrs.

The first control signal EN_DIS that turns on the fifth transistor T5 and the ninth transistor T9 is applied to the gate electrodes of the ninth transistor T9 and the fifth transistor T5 for a part of each subfield, for example, when each subfield starts or before each subfield ends. Accordingly, the ninth transistor T9 is turned on and applies the first power voltage ELVDD to the first node N1 and turns off the second transistor T2. The fifth transistor T5 is turned on and provides a discharge path for the repair line RL, thereby resetting the repair line RL.

Similarly to the dummy pixel DP2 of FIG. 9, the dummy pixel DP5 of FIG. 13 may reset the repair line RL by applying the first control signal EN_DIS that turns on the fifth transistor T5 and the ninth transistor T9, and thus the fifth transistor T5 provides the discharge path for the repair line RL in a non-emission subfield.

Figure 14:
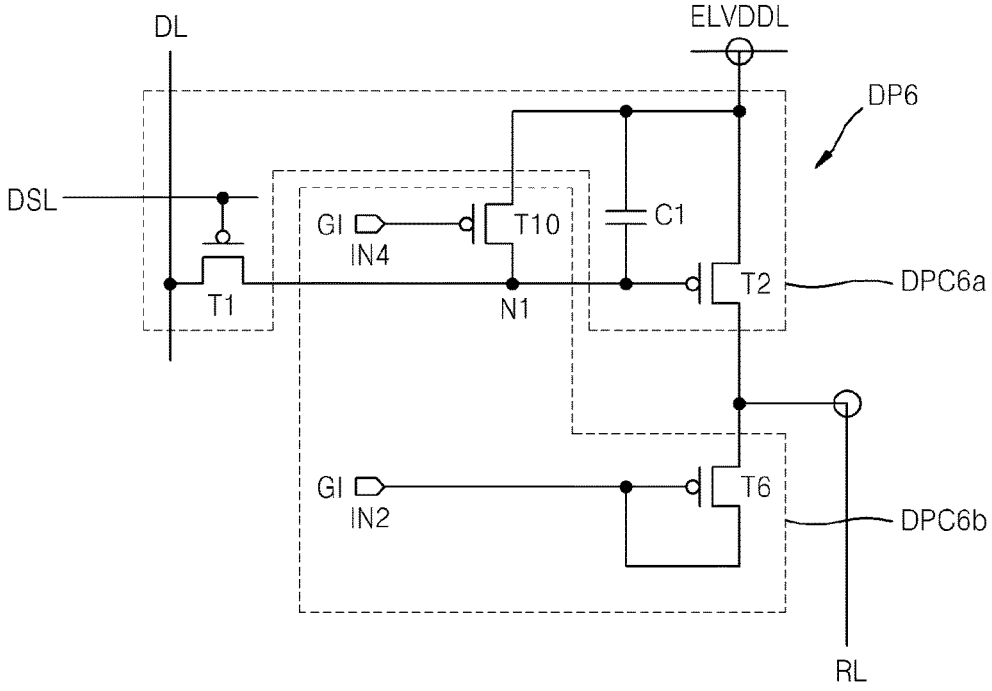

FIG. 14 is a circuit diagram of a dummy pixel DP6 according to another embodiment of the present invention.

Referring to FIG. 14, the dummy pixel DP6 may include a first dummy driving unit DPC6*a* and a second dummy driving unit DPC6*b*. The dummy pixel DP6 is the same or substantially the same as the dummy pixel DP3 of FIG. 10, except that the dummy pixel DP6 further includes a tenth transistor T10, and turn-on timing of a sixth transistor T6 is different, and thus, a detailed description of the same elements will not be repeated.

The second dummy driving unit DPC6*b* may include the sixth transistor T6 and the tenth transistor T10. The tenth transistor T10 may include a gate electrode connected to a fourth control terminal IN4, a first electrode connected to a first electrode of the second transistor T2, and a second electrode connected to a gate electrode of the second transistor T2.

When the dummy pixel DP6 is connected to the first power line ELVDDL and the repair line RL by performing a repair process, the dummy pixel DP6 may control driving of the repair pixel EPrrs.

The second control signal GI that turns on the sixth transistor T6 and the tenth transistor T10 is applied to the gate electrodes of the sixth transistor T6 and the tenth transistor T10 for a part of each subfield, for example, when each subfield starts or before each subfield ends. Accordingly, the tenth transistor T10 is turned on and applies the first power voltage ELVDD to the first node N1 and turns off the second transistor T2. The sixth transistor T6 is turned on and is diode-connected and provides a discharge path for the repair line RL, thereby resetting the repair line RL.

Similarly to the dummy pixel DP3 of FIG. 10, the dummy pixel DP6 of FIG. 14 may reset the repair line RL by applying the second control signal GI that turns on the sixth transistor T6 and the tenth transistor T10, and thus the sixth transistor T6 provides the discharge path for the repair line RL in a non-emission subfield.

Figure 15:
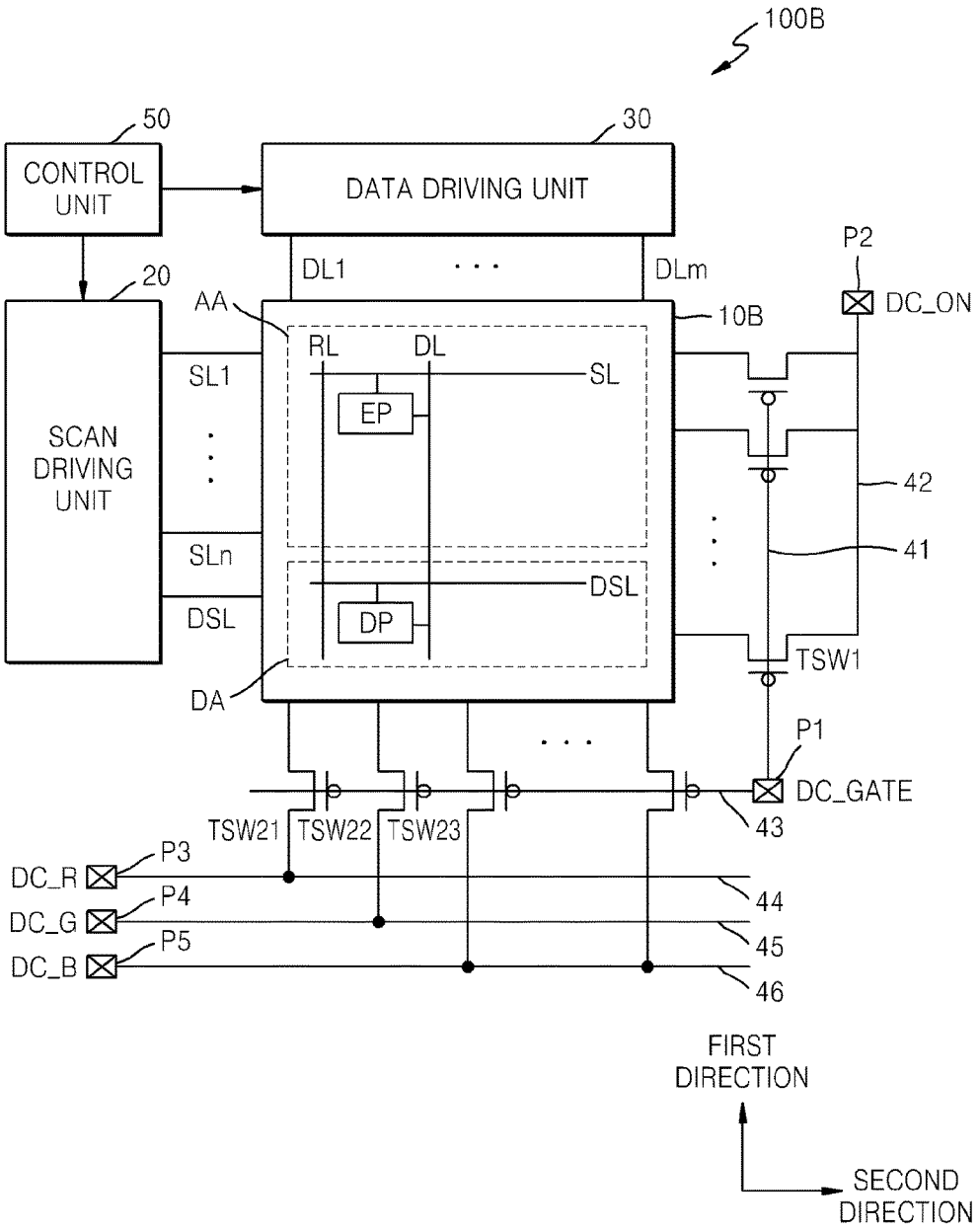
FIG. 15 is a schematic block diagram of a display device according to another embodiment of the present invention.

FIG. 15 is a schematic block diagram of a display device 100B according to another embodiment of the present invention.

Referring to FIG. 15, the display device 100B according to the present embodiment includes a display panel 10B including a plurality of pixels, a scan driving unit 20 (e.g., a scan driver 20), a data driving unit 30 (e.g., a data driver 30), and a control unit 50 (e.g., a controller 50). Hereinafter, differences between the display device 100B and the display device 100A of FIG. 1 will now be described, and thus detailed descriptions of the same elements will not be repeated.

A cell test may be performed after a panel (cell) process on the display panel 10B including a repaired defective pixel. The cell test may be performed before a module test, and may include a lightening test, a wiring defect test, a leakage current test, and/or aging. In the present embodiment, for the cell test, a plurality of first test switches TSW1 that apply test scan signals to the scan lines SL1 through SLn and the one or more dummy scan lines DSL and a plurality of second test switches TSW2 that apply test data signals to the data lines DL1 through DLm may be included in a non-display area of a substrate of the display panel 10B.

The first test switches TSW1 are individually connected to the scan lines SL1 through SLn and the one or more dummy scan lines DSL. A gate electrode of each of the first test switches TSW1 is connected to a first test control line 41, a first electrode thereof is connected to a test scan line 42 that applies a test scan signal DC_ON, and a second electrode thereof is connected to one of the scan lines SL1 through SLn and the one or more dummy scan lines DSL.

The second test switches TSW2 are individually connected to the data lines DL1 through DLm. A gate electrode of each of the second test switches TSW2 is connected to a second test control line 43, a first electrode thereof is connected to one of test data lines 44, 45, and 46 that apply test data signals, and a second electrode thereof is connected to one of the data lines DL1 through DLm. The second test switches TSW2 may include a 2-1th test switch TSW21 connected to the first test data line 44 that applies a first test data signal DC_R, a 2-2th test switch TSW22 connected to the second test data line 45 that applies a second test data signal DC_G, and a 2-3th test switch TSW23 connected to the third test data line 45 that applies a third test data signal DC_B.

Although an example of applying the first through third data signals DC_R, DC_G, and DC_B corresponding to RGB emission pixels is illustrated in FIG. 15, the present embodiment is not limited thereto. RGBW emission pixels may be provided and the first through third data signals DC_R, DC_G, and DC_B corresponding to the W emission pixel are concurrently (e.g., simultaneously) applied or signal lines that apply test data signals corresponding to emission pixels that display different colors may be added.

The first test switches TSW1 are concurrently (e.g., simultaneously) turned on when a test control signal DC_GATE is applied from a terminal P1 via the first test control line 41, and concurrently (e.g., simultaneously) apply a test scan signal DC_ON supplied from a terminal P2 to the scan lines SL1 through SLn and the one or more dummy scan lines DSL.

The 2-1th test switch TSW21, the 2-2th test switch TSW22, and the 2-3th test switch TSW23 are concurrently (e.g., simultaneously) turned on when the test control signal DC_GATE is applied from the terminal P1 via the second test control line 43. When the test scan signal DC_ON is applied to the scan lines SL1 through SLn and the one or more dummy scan lines DSL, the 2-1th test switch TSW21, the 2-2th test switch TSW22, and the 2-3th test switch TSW23 concurrently (e.g., simultaneously) apply the first test data signal DC_R, the second test data signal DC_G, and the third test data signal DC_B that are sequentially supplied from terminals P3, P4, and P5 to the data lines DL1 through DLm. Accordingly, the cell test may be performed on the display panel 10B.

Figure 16:
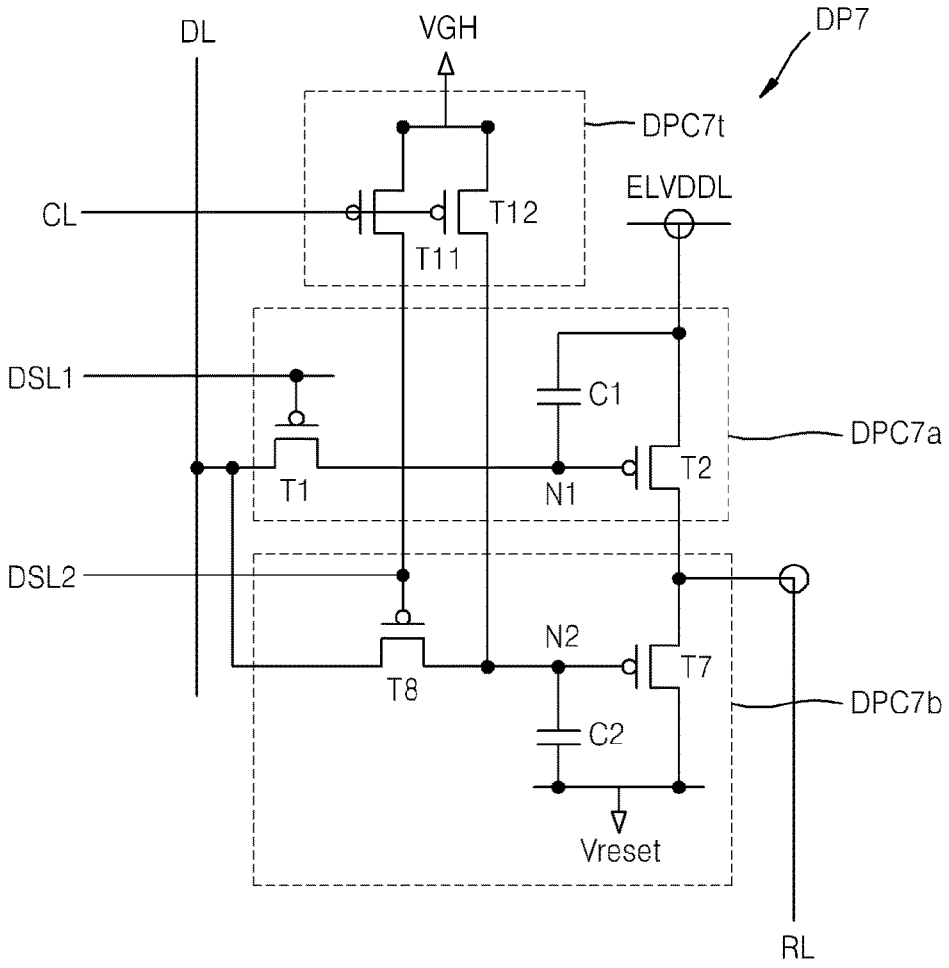
FIG. 16 is a circuit diagram of a dummy pixel according to another embodiment of the present invention.
Figure 17:
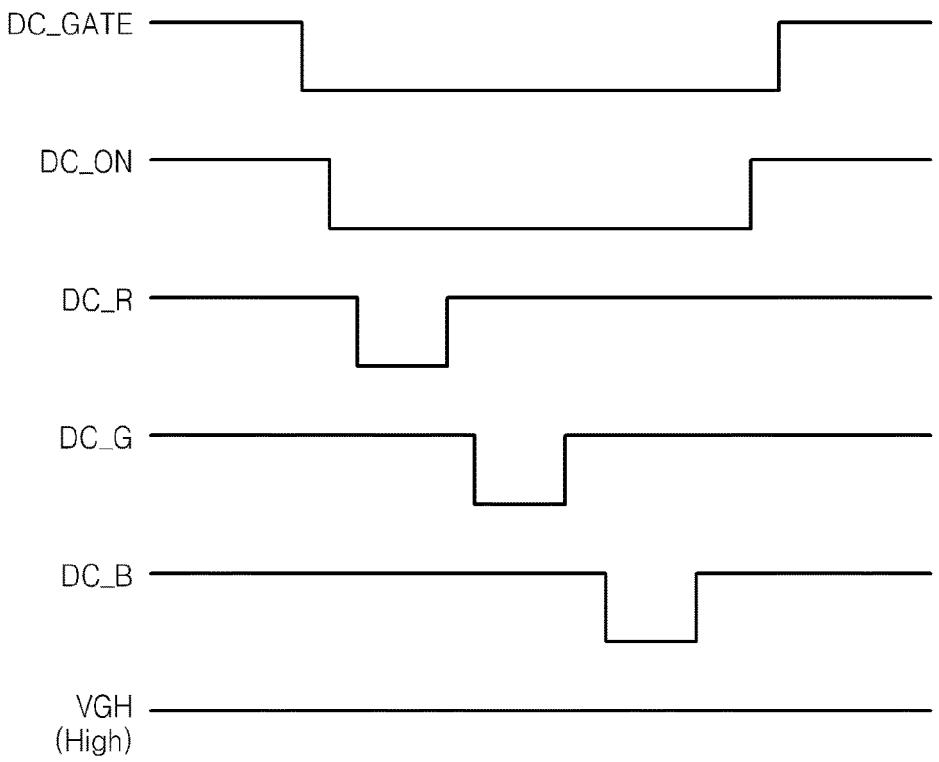
FIG. 17 is a timing diagram for explaining a cell test of the dummy pixel of FIG. 16.

FIG. 16 is a circuit diagram of a dummy pixel DP7 according to another embodiment of the present invention. FIG. 17 is a timing diagram that illustrates a cell test of the dummy pixel DP7 of FIG. 16.

Referring to FIG. 16, the dummy pixel DP7 may include a first dummy driving unit DPC7*a* (e.g., a first dummy driver DPC7*a*), a second dummy driving unit DPC7*b* (e.g., a second dummy driver DPC7*b*), and a test driving unit DPC7*t* (e.g., a test driver DPC7*t*).

The first dummy driving unit DPC7*a* and the second dummy driving unit DPC7*b* are the same or substantially the same as the first dummy driving unit DPC4*a* and the second dummy driving unit DPC4*b* of FIG. 11, and thus detailed descriptions thereof will not be repeated.

The test driving unit DPC7*t* may include an eleventh transistor T11 and a twelfth transistor T12.

A gate electrode of the eleventh transistor T11 is connected to a control line CL, a first electrode thereof is connected to a third power that supplies a control voltage VGH, and a second electrode thereof is connected to a gate electrode of the eighth transistor T8.

A gate electrode of the twelfth transistor T12 is connected to the control line CL, a first electrode thereof is connected to the third power that supplies the control voltage VGH, and a second electrode thereof is connected to a gate electrode of the seventh transistor T7.

Hereinafter, a method of driving the dummy pixel DP7 during a cell test when the dummy pixel DP7 is connected to the first power line ELVDDL and the repair line RL during a repair process will be described.

Referring to FIGS. 15 and 17, during the cell test, the first test switches TSW1 and the 2-1th test switch TSW21, the 2-2th test switch TSW22, and the 2-3th test switch TSW23 are turned on by receiving the test control signal DC_GATE of a low level. The first test switches TSW1 that are turned on concurrently (e.g., simultaneously) apply the test scan signal DC_ON of the low level to the scan lines SL1 through SLn and the one or more dummy scan lines DSL. The 2-1th test switch TSW21, the 2-2th test switch TSW22, and the 2-3th test switch TSW23 that are turned on sequentially to respectively apply the first test data signal DC_R, the second test data signal DC_G, and the third test data signal DC_B of low levels to the data lines DL1 through DLm.

Accordingly, the test scan signal DC_ON of the low level is applied to the first dummy scan line DSL1 so that the first transistor T1 is turned on, and one of the first test data signal DC_R, the second test data signal DC_G, and the third test data signal DC_B of low levels that are supplied from the data line DL is transferred to the first node N1. The second transistor T2 is turned on by a test data signal to transfer the first power voltage ELVDD to the repair pixel EPrrs connected via the repair line RL.

The test scan signal DC_ON of the low level is applied to the first dummy scan line DSL1 and the second dummy scan line DSL2 concurrently (e.g., simultaneously). The test control signal DC_GATE of the low level is applied to gate electrodes of the eleventh transistor T11 and the twelfth transistor T12 via the control line CL. Accordingly, the eleventh transistor T11 and the twelfth transistor T12 are turned on.

The eleventh transistor T11 that is turned on applies the control voltage VGH of a high level to a gate electrode of the eighth transistor T8 to turn off the eighth transistor T8. Thus, the eighth transistor T8 may be turned off in spite of the test scan signal DC_ON of the low level applied to the second dummy scan line DSL2.

The twelfth transistor T12 that is turned on applies the control voltage VGH of the high level to the second node N2 to which a gate electrode of the seventh transistor T7 is connected to turn off the seventh transistor T7, while the eighth transistor T8 is turned off and the second node N2 is floating. Accordingly, the cell test may be normally performed to enable the second dummy driving unit DPC7*b* not to operate during the cell test.

Figure 18:
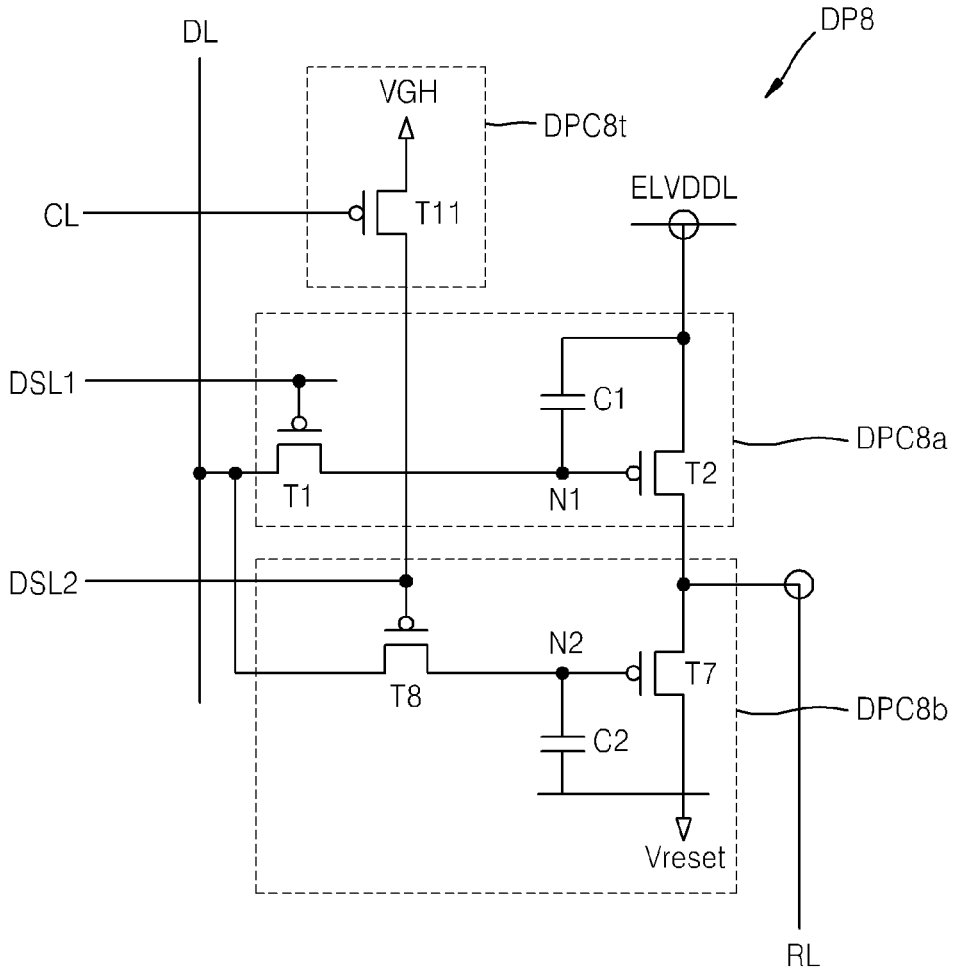
FIG. 18 is a circuit diagram of a dummy pixel according to another embodiment of the present invention.
Figure 19:
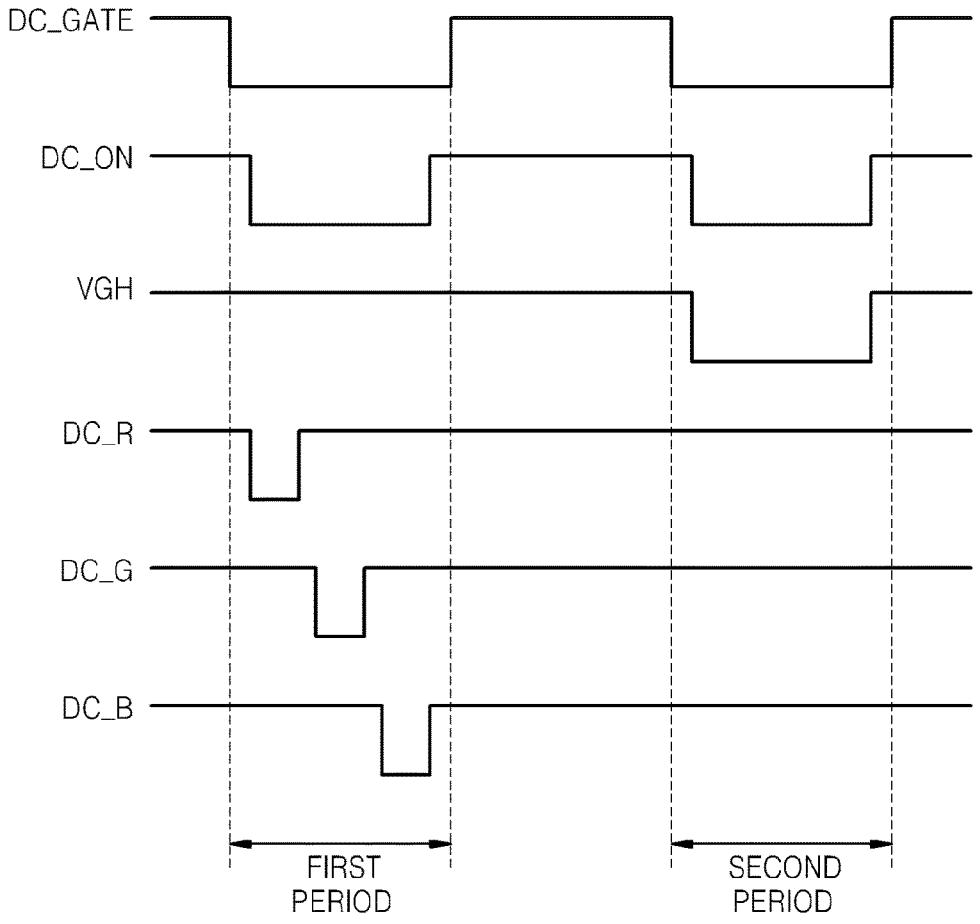
FIG. 19 is a timing diagram for explaining a cell test for the dummy pixel of FIG. 18.

FIG. 18 is a circuit diagram of a dummy pixel DP8 according to another embodiment of the present invention. FIG. 19 is a timing diagram for explaining a cell test of the dummy pixel DP8 of FIG. 18.

Referring to FIG. 18, the dummy pixel DP8 may include a first dummy driving unit DPC8*a*, a second dummy driving unit DPC8*b*, and a test driving unit DPC8*t*.

The first dummy driving unit DPC8*a* and the second dummy driving unit DPC8*b* are the same or substantially the same as the first dummy driving unit DPC4*a* and the second dummy driving unit DPC4*b* of FIG. 11, and thus detailed descriptions thereof will not be repeated. The test driving unit DPC8*t* is the same or substantially the same as the test driving unit DPC7*t* of FIG. 16, except that the twelfth transistor T12 is not included, and thus a detailed description thereof will not be repeated.

Hereinafter, a method of driving the dummy pixel DP8 during a cell test when the dummy pixel DP8 is connected to the first power line ELVDDL and the repair line RL during a repair process will now be described.

Referring to FIGS. 15 and 19, during the cell test and in a first period, the first test switches TSW1 and the 2-1th test switch TSW21, the 2-2th test switch TSW22, and the 2-3th test switch TSW23 are turned on by receiving the test control signal DC_GATE of a low level. The first test switches TSW1 that are turned on concurrently (e.g., simultaneously) apply the test scan signal DC_ON of the low level to the scan lines SL1 through SLn and the one or more dummy scan lines DSL. The 2-1th test switch TSW21, the 2-2th test switch TSW22, and the 2-3th test switch TSW23 that are turned on sequentially to respectively apply the first test data signal DC_R, the second test data signal DC_G, and the third test data signal DC_B of low levels to the data lines DL1 through DLm.

The test scan signal DC_ON of the low level is applied to the first dummy scan line DSL1 so that the first transistor T1 is turned on, and one of the first test data signal DC_R, the second test data signal DC_G, and the third test data signal DC_B of low levels that are supplied from the data line DL is transferred to the first node N1. The second transistor T2 is turned on by a test data signal to transfer the first power voltage ELVDD to the repair pixel EPrrs connected via the repair line RL.

The test scan signal DC_ON of the low level is applied to the first dummy scan line DSL1 and the second dummy scan line DSL2 concurrently (e.g., simultaneously). The test control signal DC_GATE of the low level is applied to a gate electrode of the eleventh transistor T11 via the control line CL. Accordingly, the eleventh transistor T11 is turned on and applies the control voltage VGH of a high level to a gate electrode of the eighth transistor T8 to turn off the eighth transistor T8. Thus, the eighth transistor T8 may be turned off in spite of the test scan signal DC_ON of the low level applied to the second dummy scan line DSL2.

Regularly, in a second period between the first periods, the first test switches TSW1 and the 2-1th test switch TSW21, the 2-2th test switch TSW22, and the 2-3th test switch TSW23 are turned on by receiving the test control signal DC_GATE of the low level. The first test switches TSW1 that are turned on concurrently (e.g., simultaneously) apply the test scan signal DC_ON of the low level to the scan lines SL1 through SLn and the one or more dummy scan lines DSL. The 2-1th test switch TSW21, the 2-2th test switch TSW22, and the 2-3th test switch TSW23 that are turned on concurrently (e.g., simultaneously) apply the first test data signal DC_R, the second test data signal DC_G, and the third test data signal DC_B of high levels to the data lines DL1 through DLm.

The test scan signal DC_ON of the low level is applied to the first dummy scan line DSL1 so that the first transistor T1 is turned on, and one of the first test data signal DC_R, the second test data signal DC_G, and the third test data signal DC_B of high levels that are supplied from the data line DL is transferred to the first node N1. Accordingly, the second transistor T2 is turned off.

The test scan signal DC_ON of the low level is applied to the first dummy scan line DSL1 and the second dummy scan line DSL2 concurrently (e.g., simultaneously). The test control signal DC_GATE of the low level is applied to the gate electrode of the eleventh transistor T11 via the control line CL. Accordingly, the eleventh transistor T11 is turned on.

The eleventh transistor T11 that is turned on applies the control voltage VGH of the low level to a gate electrode of the eighth transistor T8 to turn on the eighth transistor T8. One of the first test data signal DC_R, the second test data signal DC_G, and the third test data signal DC_B of high levels that are supplied from the data line DL via the eighth transistor T8 that is turned on is transferred to the second node N2. Accordingly, the seventh transistor T7 is turned off. Employing the second period, an electric potential of the second node N2 may be prevented or substantially prevented from being reduced due to the eighth transistor T8 that is floating during the first period.

According to the embodiments of the present invention, a defective pixel in a display device is repaired by using a dummy pixel, and thus, a bright spot (or spots) displayed at low gradation may be prevented or reduced. According to the embodiments of the present invention, a cell test for the dummy pixel including a reset circuit may be performed, and thus, a defect may be detected before performing a module test, thereby further increasing a manufacturing yield.

In the above-described embodiments, a leakage current may be reduced by connecting two or more transistors in series to each other (eg., multi-gate transistor).

Although an emission pixel and the dummy pixel are configured as P type transistors in the above-described embodiments, the embodiments of the present invention are not limited thereto. The pixels may be configured as N type transistors. In this case, a level of a signal applied to the P type transistors may be modified by an inverted signal.

As described above, according to the one or more of the above embodiments of the present invention, a defective pixel is easily repaired, thereby normally driving the defective pixel and increasing a production yield of a display device.

Further, a brightness deviation between a repaired pixel and a normal pixel is improved, thereby providing a display device having an excellent display quality.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims and their equivalents.

What is claimed is:

1. A display device comprising:

an emission pixel comprising an emission device, the emission pixel being in a display area;

a dummy pixel in a non-display area outside the display area; and a repair line that is connectable to the emission device of the emission pixel and to the dummy pixel, wherein the dummy pixel comprises:

a first dummy driver for receiving a same data signal as a data signal applied to the emission pixel for each of a plurality of subfields of one frame and controlling emission of the emission device of the emission pixel via the repair line; and a second dummy driver for resetting the repair line, in one of the subfields in which the emission device does not emit light.

2. The display device of claim 1, wherein the second dummy driver comprises:

a third transistor comprising a gate electrode connected to a first dummy scan line, a first electrode connected to a dummy data line that applies an inversion signal with respect to the data signal, and a second electrode connected to a second node; and a fourth transistor comprising a gate electrode connected to the second node, a first electrode connected to the first dummy driver, and a second electrode connected to a second power line.

3. The display device of claim 1, wherein the second dummy driver comprises:

a fifth transistor comprising a gate electrode configured to receive a control signal is applied, a first electrode connected to the first dummy driver, and a second electrode configured to receive a reset signal is applied.

4. The display device of claim 3, wherein the second electrode of the fifth transistor is connected to the gate electrode of the fifth transistor to receive the control signal as the reset signal.

5. The display device of claim 3, wherein the second dummy driver further comprises:

a sixth transistor comprising a gate electrode configured to receive the control signal is applied, a first electrode connected to the gate electrode of a second transistor of the first dummy driver, and a second electrode connected to the first electrode of the second transistor of the first dummy driver, wherein the sixth transistor and the fifth transistor are concurrently turned on.

6. The display device of claim 5, wherein the control signal turns on the fifth transistor and the sixth transistor in a part of each of the plurality of subfields.

7. The display device of claim 1, wherein the first dummy driver comprises:

a first transistor comprising a gate electrode connected to a first dummy scan line, a first electrode connected to a data line, and a second electrode connected to a first node;

a second transistor comprising a gate electrode connected to the first node, a first electrode configured to be connectable to a first power source, and a second electrode connected to the second dummy driver; and a first dummy capacitor comprising a first electrode connected to the first node and a second electrode connected to the first electrode of the second transistor.

8. The display device of claim 7, wherein the second dummy driver comprises:

a seventh transistor comprising a gate electrode connected to a second dummy scan line, a first electrode connected to the data line, and a second electrode connected to a second node;

an eighth transistor comprising a gate electrode connected to the second node, a first electrode connected to the first dummy driver, and a second electrode connected to a second power source; and a second dummy capacitor disposed between the gate electrode and the second electrode of the eighth transistor.

9. The display device of claim 8, wherein a first scan signal applied to the first dummy scan line precedes or follows a second scan signal applied to the second dummy scan line, and wherein the data signal is applied to the data line in response to the first scan signal, and an inversion signal with respect to the data signal is applied to the data line in response to the second scan signal.

10. The display device of claim 8, further comprising:

a ninth transistor comprising a gate electrode connected to a control line, a first electrode connected to a third power source, and a second electrode connected to the gate electrode of the seventh transistor.

11. The display device of claim 10, wherein the ninth transistor:

is turned on by receiving a test gate signal from the control line when a scan signal is applied from the second dummy scan line;

turns off the seventh transistor during a first period;

turns on the seventh transistor during a second period; and transfers a voltage having a level to turn off the eighth transistor to the second node.

12. The display device of claim 10, further comprising:

a tenth transistor comprising a gate electrode connected to the control line, a first electrode connected to the third power source, and a second electrode connected to the second electrode of the seventh transistor.

13. The display device of claim 12, wherein, when a scan signal is applied from the second dummy scan line, the ninth transistor is turned on by receiving a test gate signal from the control line to turn off the seventh transistor, and the tenth transistor is turned on by receiving the test gate signal from the control line to turn off the eighth transistor.

14. The display device of claim 1, wherein the emission device of the emission pixel is separated from a driver of the emission pixel, and the emission device of the emission pixel and the dummy pixel are connected to the repair line.

15. A pixel that is connectable to an external pixel via a repair line and enables the external pixel to display gradation by adjusting an emission time of the external pixel according to a data signal supplied to each of a plurality of subfields of one frame, the pixel comprising:

a first transistor comprising a gate electrode connected to a first scan line, a first electrode connected to a first data line that applies the data signal, and a second electrode connected to a first node;

a second transistor comprising a gate electrode connected to the first node, a first electrode connected to a first power source, and a second electrode connectable to the repair line;

a first capacitor comprising a first electrode connected to the first node and a second electrode connected to the first electrode of the second transistor; and a third transistor connected to the second transistor and connectable to the repair line.

16. The pixel of claim 15, wherein the second transistor and the third transistor are connected to the repair line so that the pixel is connected to an emission device of the external pixel.

17. The pixel of claim 16, further comprising:

a fifth transistor disposed between a gate electrode of the second transistor and the first power source, wherein the fifth transistor and the third transistor are concurrently turned on so that the fifth transistor transfers a voltage having a level to turn off the second transistor to the first node, and wherein the repair line is reset via the third transistor that is turned on.

18. The pixel of claim 17, wherein the third transistor and the fifth transistor are turned on during a part of each of the plurality of subfields.

19. The pixel of claim 16, wherein the second transistor is turned off and the third transistor is turned on in one of the plurality of subfields in which the external pixel does not emit light, and wherein the repair line is reset via the third transistor that is turned on.

20. The pixel of claim 19, further comprising:

a fourth transistor disposed between a gate electrode of the third transistor and a second data line configured to receive an inversion signal with respect to the data signal is applied, wherein the first transistor and the fourth transistor are concurrently turned on.

21. The pixel of claim 19, further comprising:

a sixth transistor connected between the first data line and a gate electrode of the third transistor; and a second capacitor comprising a first electrode connected to the gate electrode of the third transistor and a second electrode connected to a second power source, wherein the sixth transistor is turned on before or after the first transistor, wherein the data signal is applied to the first data line when the first transistor is turned on, and wherein an inversion signal with respect to the data signal is applied to the first data line when the sixth transistor is turned on.

22. The pixel of claim 21, further comprising:

a seventh transistor disposed between the gate electrode of the sixth transistor and a third power source.

23. The pixel of claim 22, further comprising:

an eighth transistor disposed between a gate electrode of the third transistor and the third power source.

24. A method of driving a display device comprising an emission pixel and a dummy pixel, the emission pixel being connected to the dummy pixel via a repair line, the method comprising:

controlling, by the dummy pixel, emission of an emission device of the emission pixel via the repair line, and adjusting an emission time of the emission device of the emission pixel to display gradation by the emission pixel, according to a data signal applied to the dummy pixel for each of a plurality of subfields of one frame, and resetting, by the dummy pixel, the repair line in one of the subfields in which the emission device does not emit light.

* * * * *